US005613785A

United States Patent [19]

Yasuoka

[11] Patent Number: 5,613,785

[45] Date of Patent: Mar. 25, 1997

[54] DOT IMPACT PRINTER HAVING A INK RIBBON LOADING MEANS

[75] Inventor: Tadashi Yasuoka, Tokyo, Japan

[73] Assignee: Seiko Precision Inc., Tokyo, Japan

[21] Appl. No.: 530,589

[22] Filed: Sep. 19, 1995

Related U.S. Application Data

[63] Continuation of Ser. No. 217,323, Mar. 24, 1994, abandoned.

[30] Foreign Application Priority Data

Mar. 24, 1993 [JP] Japan ..... 5-065594
Sep. 10, 1993 [JP] Japan ..... 5-225479

[51] Int. Cl.[6] ..... B41J 35/03

[52] U.S. Cl. ..... 400/248; 400/245.1; 400/247

[58] Field of Search ..... 400/55, 56, 57, 400/58, 59, 60, 247, 248, 248.1, 248.2

[56] References Cited

U.S. PATENT DOCUMENTS 4,119,385 10/1978 Watanabe et al. ..... 400/215.3
4,676,679 6/1987 Kondo et al. ..... 400/215.3
5,088,846 2/1992 Yamaguchi ..... 400/248.1

FOREIGN PATENT DOCUMENTS 0035967 2/1984 Japan ..... 400/248.2

*Primary Examiner*—John S. Hilten
*Attorney, Agent, or Firm*—Amster, Rothstein & Ebenstein

[57] ABSTRACT

Disclosed is a dot impact printer wherein a ribbon cassette formed, at its both end portions, with a pair of arm portions, respectively, between which an ink ribbon is exposed, and the ink ribbon therebetween is inserted and placed between a printing head and a platen. According to the first invention, the printer comprises a supporting frame displaceable between a first position for inserting the ink ribbon into the printing head and the platen and a second position for drawing out the ink ribbon from between these two. According to the second invention, the printer comprises an auto loading means which, in a condition in which the ribbon cassette is retained by the supporting frame, moves the ink ribbon to an insertion position where it is inserted between the printing head and the platen and to a draw-out position where it is drawn out from between these two.

8 Claims, 16 Drawing Sheets

DOT IMPACT PRINTER HAVING A INK RIBBON LOADING MEANS

This is a continuation of application Ser. No. 08/217,323 filed on Mar. 24, 1994 now abandoned.

BACKGROUND OF THE INVENTION

The present invention relates to a dot impact printer.

DESCRIPTION OF THE RELATED ART

In a dot impact printer, a ribbon cassette formed, at its both ends, with arm portions respectively and having an ink ribbon exposed between the arm portions is loaded, whereupon the ink ribbon between the arm portions of the ribbon cassette is inserted into and placed in between a printing head and a platen. During the printing operation, a recording sheet of paper is fed into between the platen and the ink ribbon, whereupon a printing element of the printing head impacts upon the recording sheet of paper via the ink ribbon. As a result, the recording paper is printed.

In this type of dot impact printer, the ribbon cassette is engaged with, for example, a printer frame via engaging means so as to enable the ribbon cassette to be loaded or unloaded if necessary at the time of, for example, exchange of the ribbon cassette.

However, in the conventional structure, when the ribbon cassette is loaded or unloaded, the ink ribbon is simultaneously inserted into or drawn off from between the printing head and the platen. For this reason, it is necessary to load the ribbon cassette while inserting the ink ribbon into between the printing head and the platen, or to unload the ribbon cassette while drawing off the ink ribbon from between the printing head and the platen, posing a problem that the ribbon cassette can not easily be loaded or unloaded.

SUMMARY OF THE INVENTION

In view of the above, it is an object of the present invention to provide a dot impact printer which enables easy loading and unloading of the ribbon cassette.

According to one aspect of the present invention, there is provided a dot impact printer wherein a ribbon cassette formed, at its both end portions, with a pair of arm portions, respectively, between which an ink ribbon is exposed; and the ink ribbon between the arm portions is inserted and placed between a printing head and a platen, the dot impact printer comprising a supporting frame which supports the ribbon cassette in a removably attachable manner and which is provided in a manner displaceable to either one of a first and a second position, the first position being intended to permit the ink ribbon between the arm portions to be inserted and placed between the printing head and the platen, and the second position being intended to permit the ink ribbon between the arm portions to be drawn off from between the printing head and the platen, and driving means for driving the supporting frame to the first position and the second position.

According to another aspect of the present invention, there is provided a dot impact printer wherein a ribbon cassette formed, at its both end portions, with a pair of arm portions, respectively, between which an ink ribbon is exposed; and the ink ribbon between the arm portions is inserted and placed between a printing head and a platen, the dot impact printer comprising a supporting frame for fixedly retaining the ribbon cassette in a removably attachable manner, and an auto loading means which, in a condition wherein the ribbon cassette is retained by the supporting frame, moves the ink ribbon between the arm portions to an insertion position at which the ink ribbon is inserted between the printing head and the platen and to a draw-out position at which the ink ribbon is drawn out from between the printing head and the platen.

According to the first invention, the supporting frame is driven to move, by the driving means, to the first and the second position. When the supporting frame is located at the first position, the ink ribbon between the arm portions is inserted and placed between the printing head and the platen. When the supporting frame is located at the second position, the ink ribbon between the arm portions of the ribbon cassette is drawn off from between the printing head and the platen.

Accordingly, if the supporting frame is driven to the second position by the driving means and, in this condition, the ribbon cassette is loaded and unloaded in and from the supporting frame, the ribbon cassette can be easily loaded or unloaded with no need to load the ribbon cassette while inserting the ink ribbon between the printing head and the platen, or to unload the ribbon cassette while withdrawing the ink ribbon from between the printing head and the platen.

Further, according to the second invention, through the operation of the auto loading means, in a condition in which the ribbon cassette is retained by the supporting frame, the ink ribbon between the arm portions can be moved to either one of the insertion position where this ink ribbon is inserted into between the printing head and the platen and the draw-out position where the ink ribbon is drawn out from between the two.

Accordingly, the ink ribbon can be easily loaded or unloaded with no need to set the ribbon cassette while inserting the ink ribbon into between the printing head and the platen, or unload the ribbon cassette while drawing off the ink ribbon from between the two.

Other objects, features, and advantages of the present invention will become apparent from the following description taken in conjunction with the accompanying drawings in which.

DESCRIPTION OF THE PREFERRED EMBODIMENTS

A dot impact printer, to which the first invention is applied, will now be described with reference to the accompanying drawings.

Figure 1:
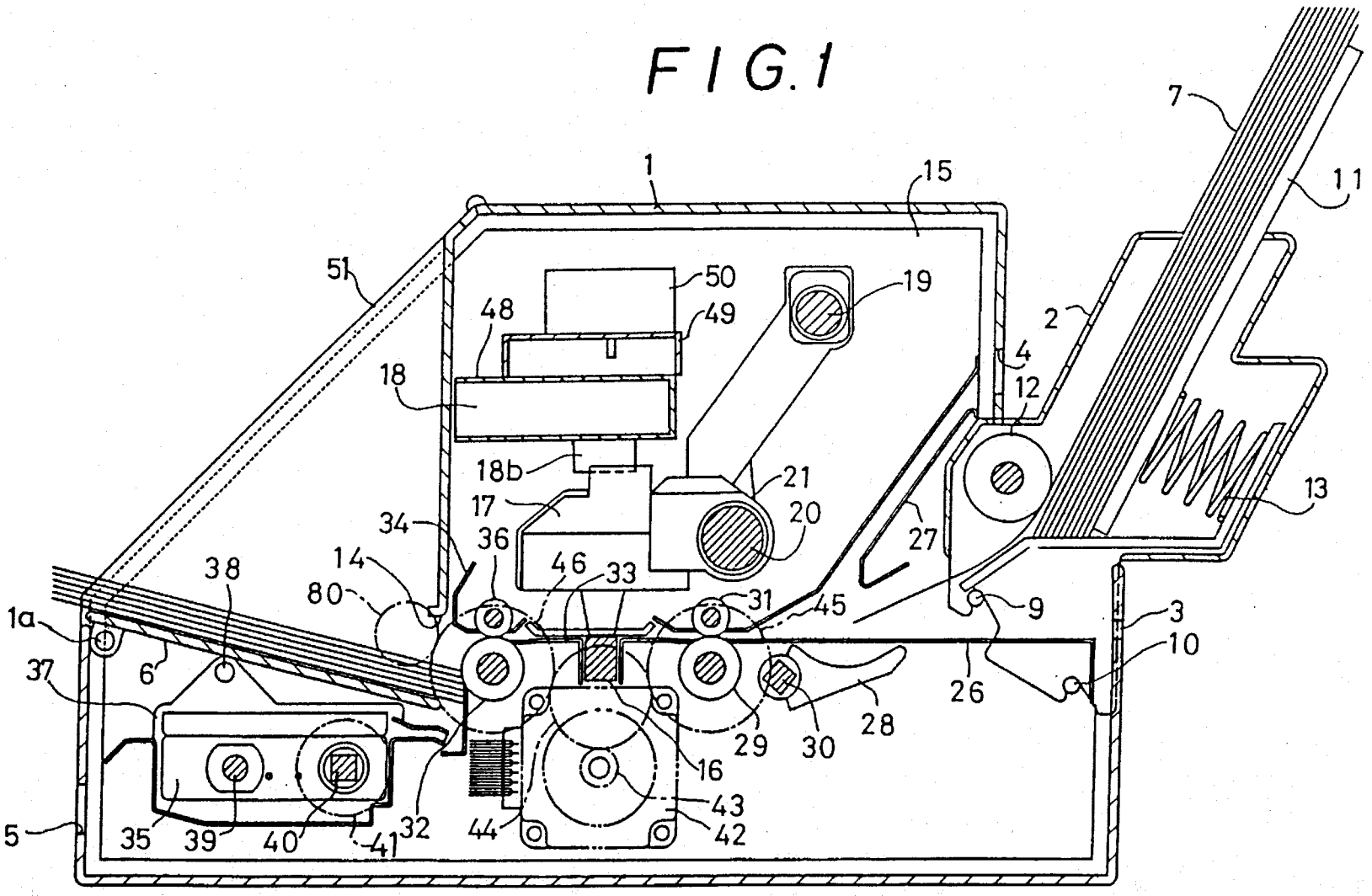
FIG. 1 is a longitudinal sectional view showing a condition of automatic paper feed of a cut paper in one embodiment of the first invention.
Figure 2:
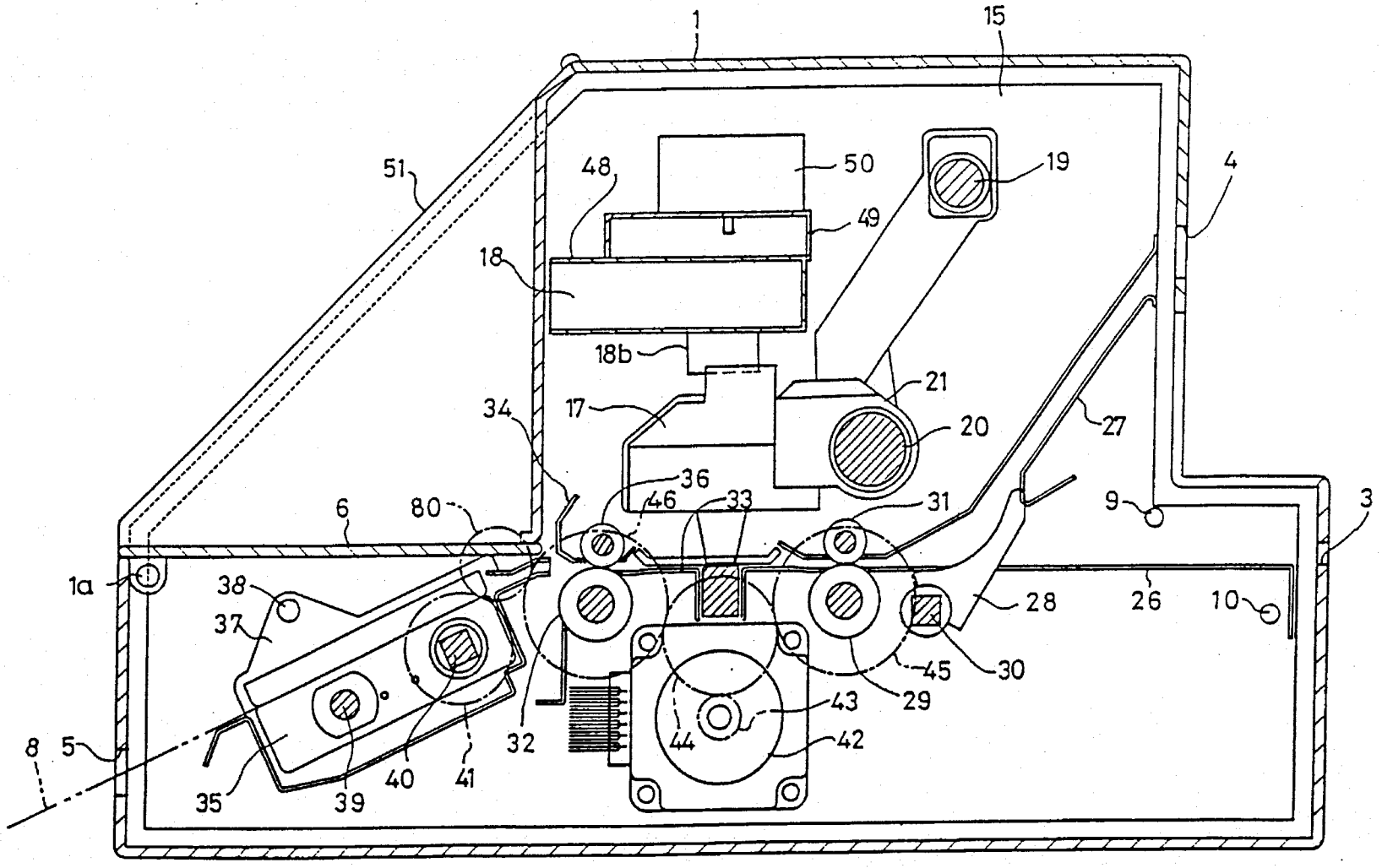
FIG. 2 is a longitudinal sectional view showing a condition of paper feed of a continuous paper in the mentioned one embodiment.

In this printer, paper discharge slots 3, 4 for a continuous paper, as well as a cut sheet feeder 2, are provided at a rear-face portion of a printer housing 1, as shown in FIG. 1. A paper receiving tray 6 for a cut paper, as well as a paper supply slot 5 for a continuous paper, is provided at a front-face of the printer housing 1. The cut paper 7 is fed by the cut sheet feeder 2 and is printed. After this printing, the cut sheet of paper 7 as printed is discharged onto an upper surface of the paper receiving tray 6. As shown in FIG. 2, the continuous paper 8 is fed through the paper supply slot 5 and is printed. After printing, the continuous paper 8 as printed is selectively discharged through the paper discharge slot 3 or 4.

The cut sheet feeder 2 is removably attached via an engaging pin 9 or 10, and this sheet feeder 2 is made removable if necessary. When the cut sheet feeder 2 is detached, the mounting portion therefor is closed by a cover not shown. The cut sheet feeder 2 is provided with a hopper plate 11 on which the cut sheets of paper 7 are placed, a picking roller 12 which opposes an uppermost one of the cut sheets of paper 7, and a compression coil spring 13 for urging the hopper plate 11. The uppermost cut sheet of paper 7 is pressed against the picking roller 12 with an urging force of the compression coil spring 13, so as to be fed with co-operation of the picking roller 12. This roller 12 is driven to rotate with the drive force of a picking motor not shown.

Figure 3:
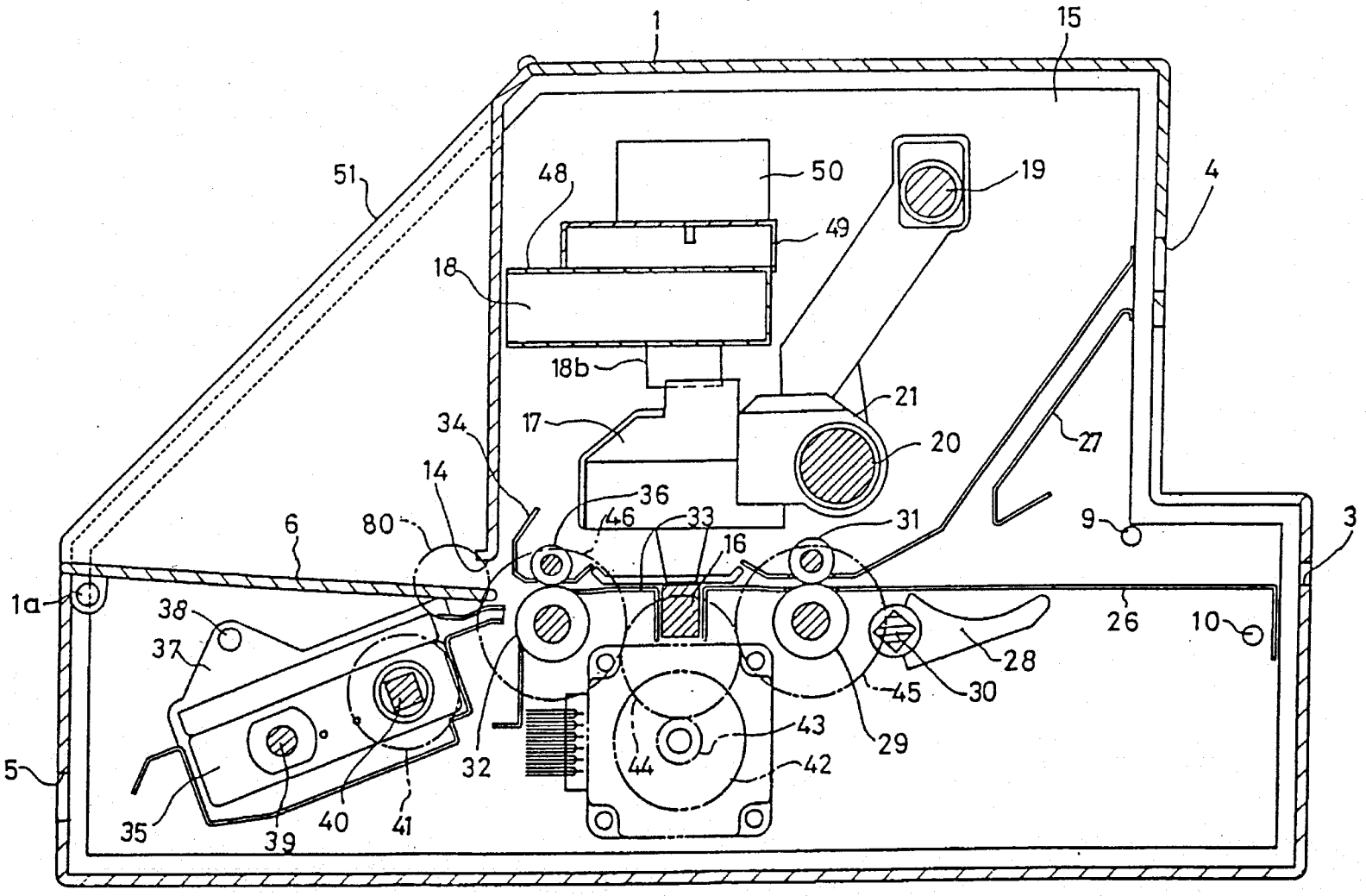
FIG. 3 is a longitudinal sectional view showing a condition of manual paper feed of a cut paper in the mentioned one embodiment.

An opening portion 14, as shown in FIG. 1, is provided between the paper receiving tray 6 and a part of the printer housing 1, whereupon the printed cut sheet 7 is discharged, via that opening portion, onto the upper surface of the tray 6. The paper receiving tray 6 is rockably supported via a pin la so as to make the opening width of the opening portion 14. As a result, during the use of the continuous paper 8, the tray 6 closes the opening portion 14 as shown in FIG. 2 to concurrently serve as a soundproofing cover. Also, as shown in FIG. 3, the tray 6 reduces the opening width of the opening portion 14 to serve as a manually inserted paper guide as well. Namely, in this printer, three kinds of paper supply modes can be used: paper supply of the continuous paper 8; automatic paper supply of the cut paper 7 made using the cut sheet feeder 2; and paper supply of the cut sheet 7 by manual insertion.

Within the printer housing 1, on both sides thereof side plates 15 are disposed in parallel and opposed relation to each other. A platen 16, a printing head 17, and a ribbon cassette 18 are disposed between the side plates 15.

The platen 16 is fixed, at its ends, to the side plates 15, respectively, and this platen extends in a direction perpendicular to the direction of paper feeding. The platen 16 opposes the printing head 17, between both of which the cut paper 7 or continuous paper 8 is fed.

The printing head 17 is loaded on a head carrier 21 engaged with a pair of guide shafts 19, 20, which extend in parallel relation to the platen 16. One guide shaft 19 is supported, at its both ends, to both the side plates 15, respectively, and is engaged, at its intermediate portion, with the head carrier 21. Both end portions of the other guide shaft 20 are reduced in diameter into eccentric shaft portions **20*a*, respectively. Each eccentric shaft portion 20*a* is rotatably supported by the corresponding side plate 15. An intermediate portion of the other guide shaft 20 has the head carrier 21 engaged therewith. The guide shafts 19, 20 and the head carrier 21 are engaged with each other so that, when the printing head 17 slides in parallel with the platen 16 and the eccentric shaft portions 20*a* of the guide shaft 20 are rotated, the printing head 17 may be brought into, or out of, contact with the platen 16. The eccentric shaft portions 20*a* of the guide shaft 20 protrude outwardly from the side plates 15, respectively, and driving gears 22 are coaxially secured to tip end portions of the protruded shaft portions, respectively. To the driving gears 22 there is transmitted the drive force of a motor 24 via reduction gears 23, 65, 66, and 67 and via a pinion gear 25, whereupon the driving gears 22 are driven to rotate with the drive force of the motor 24. Namely, through the drive of the motor 24, the printing head 17 is moved toward, or away from the platen 16 so as to adjust the spacing between the printing head 17 and the platen 16. Note that the motor 24 is mounted to the side plate 15. Note also that each driving gear 22 is formed with a notch 22*a* at a part of its outer peripheral surface. This notch is used for mounting a screw not shown for fixing the driving gear 22 to the corresponding eccentric shaft portion 20*a*. Further, in a range in which the spacing between the printing head 17 and the platen 16 is adjusted, the notch 22*a* of the driving gear does not happen to oppose the reduction gear 23. As a result, it is possible to adjust the spacing between the printing head 17 and the platen 16** without hindrance.

At the upstream side of the printing head 17 there are provided a paper guide 26 for guiding the cut paper 7 into a space between the printing head 17 and the platen 16 during the use of the cut sheet feeder 2 and for guiding the continuous paper 8 to the paper discharge slot 3 during the use of the continuous paper 8, a paper guide 27 for guiding the continuous paper 8 to the paper discharge slot 4 during the use of the continuous paper 8, a paper switching lever 28 for switching a paper discharge path via which the continuous paper 8 is discharged, during the use of the continuous paper 8, so as to cause this paper 8 to be selectively discharged from either one of the paper discharge slots 3 and 4, and a paper feed roller 29 for feeding the cut paper 7 to the space between the printing head 17 and the platen 16 during the use of the cut sheet feeder 2 and for feeding the printed continuous paper 8 to either one of the paper discharge slots 3 and 4 during the use of the continuous paper 8.

The paper guides 26 and 27 are provided in such a manner as to extend, in parallel and opposed relation to each other, from between the printing head 17 and the platen 16 to an upstream side of the paper feed roller 29 and, at this upstream side, branch the paper discharge passageway for the continuous paper 8 into the above-mentioned paper discharge paths. The paper switching lever 28 is mounted, at its one end, to a driving shaft 30 at a position where the paper discharge passageway from the continuous paper 8 is branched. This lever 28 is rocked through the rotation of the driving shaft 30 to thereby change over one paper discharge path to the other paper discharge path, or vice versa, for the continuous paper 8. The driving shaft 30 is driven to rotate with the drive force of a motor not shown. The paper feed roller 29 has a driven or pinch roller 31 disposed in opposed relation thereto so as to hold the cut paper 7 or continuous paper 8 between the roller 29 and this driven roller 31 and feed the same. To the driven roller 31 there is transmitted the rotating force of the paper feed roller 29 through operation of a gear not shown.

At the downstream side of the printing head 17, there are provided a paper discharge roller 32 for feeding the cut paper 7 to the opening portion 14 during the use of the cut sheet feeder 2, as well as for feeding the manually inserted cut paper 7 to between the printing head 17 and the platen 16 at the time of manual paper insertion and for feeding the continuous paper 8 to between the printing head 17 and the platen 16 during the use of the continuous paper 8, a paper guide 33 for guiding the cut paper 7 or continuous paper 8 from the paper discharge roller 32 to between the printing head 17 and the platen 16 or vice versa, a paper guide 34 for guiding the cut paper 7 from the paper discharge roller 32 to the opening portion 14 or vice versa, and a tractor 35 provided at the downstream side of the paper discharge roller 32 so as to cause the continuous paper 8 to be fed to the paper discharge roller 32 during the use of the continuous paper 8.

The paper discharge roller 32 has a driven or pinch roller 36 disposed in opposed relation thereto so as to pinch the cut paper 7 or continuous paper 8 between the roller 32 and this pinch roller 36. To the pinch roller 36 there is transmitted the rotating force of the paper discharge roller 32 through the rotation of a gear not shown. The paper discharge roller 32 is driven to rotate, by a paper feed motor 42, together with the paper feed roller 29 during the feed of the cut paper 7 or continuous paper 8. Namely, a pinion gear 43 is mounted to a driving shaft of the paper feed motor 42 while, on the other hand, an intermediate gear 44 is meshed with the pinion gear 43. Driving gears 45 and 46 which are meshed with the intermediate gear 44 are meshed with the paper feed roller 29 and the paper discharge roller 32, respectively. Thus, the paper feed roller 29 and the paper discharge roller 32 are driven to rotate, by the paper feed motor 42, via the pinion gear 43, intermediate gear 44 and driving gears 45, 46 during the feed of the cut paper 7 or continuous paper 8.

The tractor is provided one pair in number (in the drawings, one-side tractor only is shown). These paired tractors are loaded within a tractor frame 37, which extends in a direction perpendicular to the feeding direction of the continuous paper 8. The tractor frame 37 is rockably supported, at its both ends, by the side plates 15 via a pair of supporting pins 38, respectively and this tractor frame 37 can have its attitude changed by being rocked about each supporting pin 38 through operation of driving means not shown. The tractor frame 37 has a free end portion which is located under the paper receiving tray 6 and is engaged therewith. By this engagement, the paper receiving tray 6 can be changed over to any one of three positions: a position (first position) for use of the cut sheet feeder 2; a position (third position) for supply of the manually inserted paper; and a position (second position) for use of the continuous paper 8. Namely, through the alteration in attitude of the tractor frame 37, the paper receiving tray 6 is rocked about the pin 15. Through this rocking movement, the tray 6 can be switched, in position, to any one of the above-mentioned first to third positions.

The tractor frame 37 is provided with a guide shaft 39 and a driving shaft 40, both of which extend in a direction perpendicular to the feeding direction of the continuous paper 8. Each tractor 35 is slidably engaged with the guide shaft 39 and the driving shaft 40 so as to be positionally adjusted in corresponding relation to the width dimension of the continuous paper 8. The tractors 35 are provided with sprockets not shown which are integrally rotated with the driving shaft 40. The both sides of the continuous paper 8 are engaged with those sprockets, whereupon the continuous paper 8 is set and is fed through the rotation of the driving shaft 40. To the driving shaft 40 there is mounted, at its one end, a driving gear 41 via which the driving shaft 40 is driven to rotate, by the paper feed motor 42, together with the paper feed roller 29 and the paper discharge roller 32 during the use of the continuous paper 8. More specifically, when the tractor frame 37 is changed over to the position for use of the continuous paper 8, the driving gear 41 is meshed with an intermediate gear 80 meshed with a driving gear 46. As a result, during the use of the continuous paper 8, the driving shaft 40 is driven to rotate with the drive force of the paper feed motor 42 together with the paper feed roller 29 and the paper discharge roller 32. Note that when the tractor frame 37 has been changed over to either its position for use of the cut sheet feeder 2 or its position for the manual paper insertion, the driving gear 41 is disengaged from the intermediate gear 80. Thus, in such a case, the driving shaft 40 is never driven for rotation.

Figure 6:
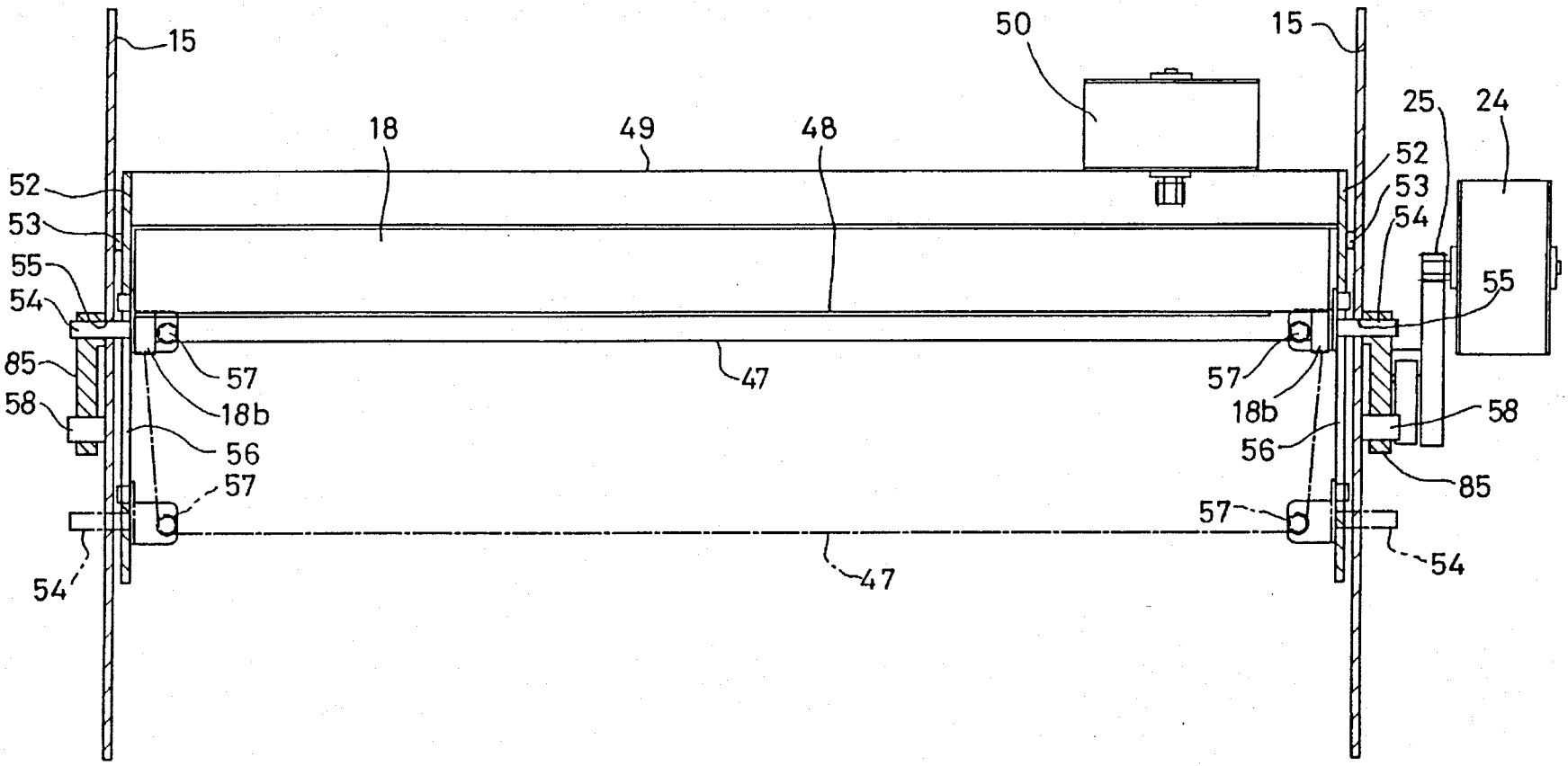
FIG. 6 is a sectional view of an essential portion of FIG. 5.

The ribbon cassette 18 is formed, at its both ends, with a pair of arm portions **18*b* which protrude orthogonally to a flat face of the cassette, as shown in FIG. 6, and between which an ink ribbon 47 is exposed. The ribbon cassette 18 is attachably and detachably accommodated in a supporting frame 48, and is horizontally installed. In this condition, the ink ribbon 47 between the arm portions 18*b* is loaded, or inserted and disposed, between the printing head 17 and the platen 16**.

The supporting frame 48 has mounted thereto a gear box 49 which contains a train of ribbon-driving wheels not shown. A ribbon-feed motor 50 for driving the ribbon-driving wheel train is also mounted thereon. By this motor 50, the ink ribbon can be driven via the ribbon-driving wheel train. The supporting frame 48 is so arranged as to permit removable loading of the ribbon cassette 18 from a front-face side of the printer housing 1. More specifically, the printer housing 1 is mounted, at its front-face portion, with an opening/closing cover 51, and a ribbon cassette accommodation portion of the supporting frame 48 is made open toward the front face of the printer housing 1. As a result, by opening the opening/closing cover 51, the ribbon cassette 18 can be removably loaded from the front-face side of the printer housing 1.

Figure 4:
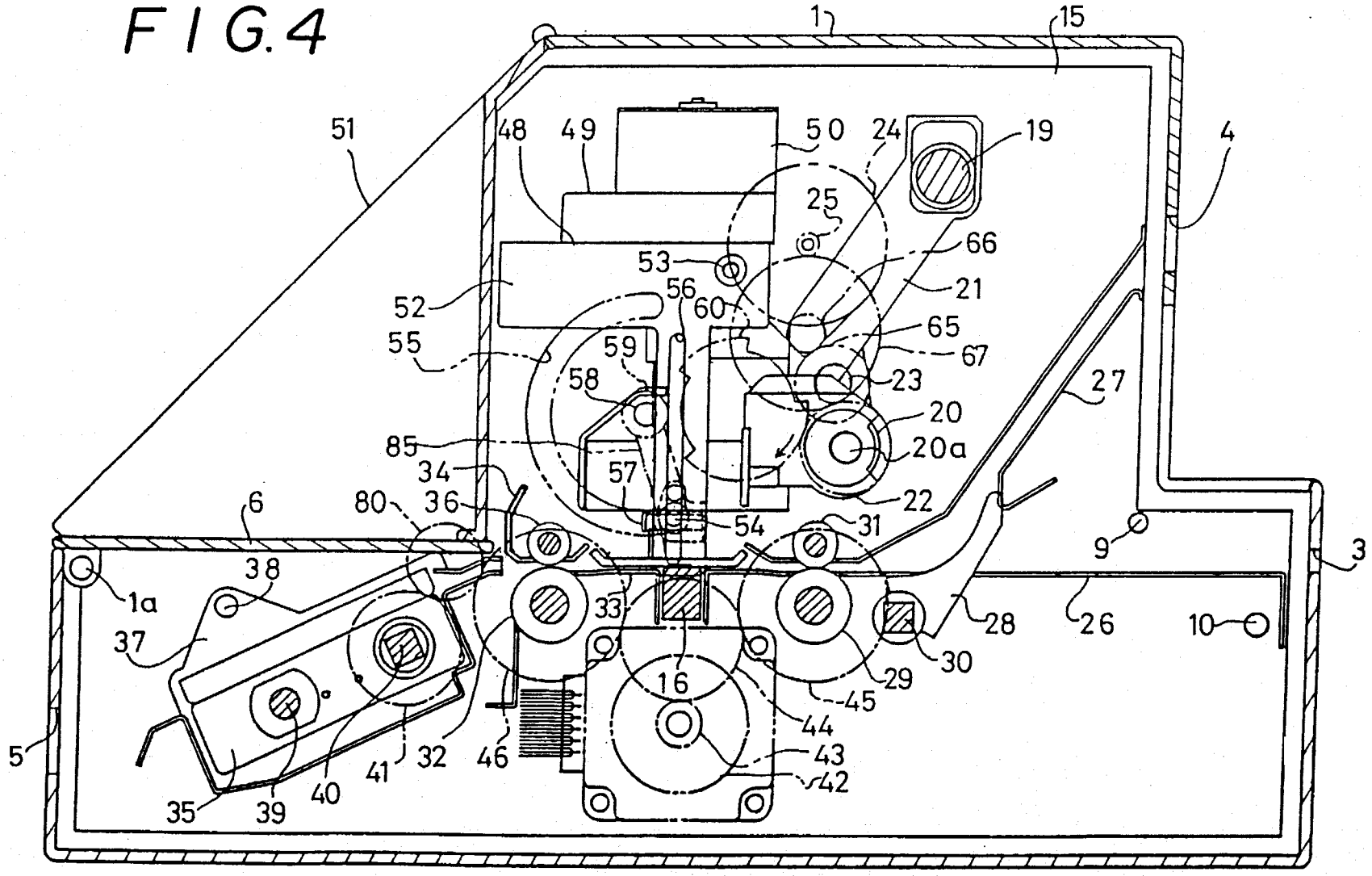
FIG. 4 is a longitudinal sectional view showing a structure of driving a supporting frame in the mentioned one embodiment.

The supporting frame 48 is integrally formed, at its both sides, with a pair of supporting plates 52, as shown in FIGS. 4 and 6, and corresponding ones of a pair of fixed pins 53 and a pair of movable pins 54 are engaged with the pair of supporting plates 52, respectively. Thus, the supporting frame 48 is horizontally supported by the side plates 15 via the fixed pins 53 and the movable pins 54. The fixed pin 53 is erected on and fixed to the side plate 15 and is rockably engaged with the supporting plate 52. The movable pin 54 is connected to one end portion of an arm 85 rotatably supported by the side plate 15, and this pin 54 is also slidably engaged with an engaging groove 56 formed in the supporting plate 52 in the form of an elongate slot. The arm 85, engaging groove 56, and movable pin 54 are so designed that the supporting frame 48 may have its posture altered through the rocking movement of the arm 85. Note that the side plate 15 is formed with a circular-arc like guide groove 55 along a moving locus of the movable pin 54.

Figure 5:
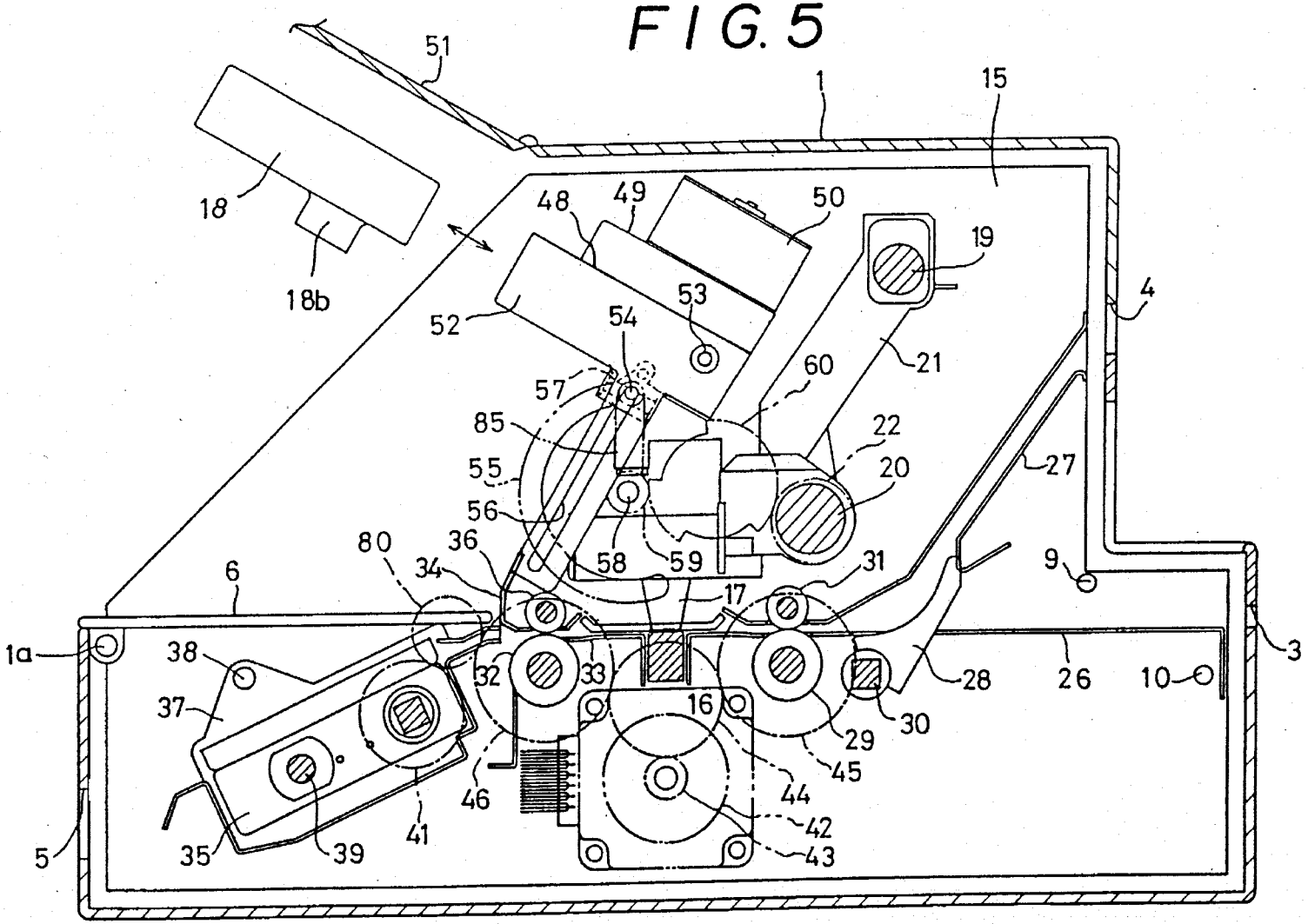
FIG. 5 is a longitudinal sectional view showing the operation of the supporting frame in the mentioned one embodiment.

The supporting frame 48 is so designed as to have its posture changed so that the ink ribbon 47 between the arm portions **18*b* may be inserted into, and taken out of, a space between the printing head 17 and the plate 16. That is, the supporting frame 48 is so designed as to have its posture altered to one of its horizontal condition and its condition obliquely upwardly directed toward the front-face side of the printer housing 1 as shown in FIGS. 4 and 5. When the supporting frame 48 is in its horizontal condition as shown in FIG. 4, the ink ribbon 47 between the arm portions 18*b* is inserted and placed between the printing head 17 and the platen 16. Conversely, when the supporting frame 48 is in its condition obliquely upwardly directed toward the front-face side of the printer housing 1 as shown in FIG. 5, the ink ribbon 47 between the arm portions 18*b* is drawn off from between the printing head 17 and the platen 16**.

The movable pin 54 is integrally movably provided with an engaging pin 57 engageable with the ink ribbon 47 extended between the arm portions **18*b* of the ribbon cassette 18, the engaging pin 57 serving as a moving member constituting an auto-loading means. By being guided by the engaging pins 57, the ink ribbon 47 between the arm portions 18*b* is loaded, or inserted and placed, between the printing head 17 and the platen 16. Namely, each arm portion 18*b* is set to have a short length, and, from a fore end thereof, the ink ribbon 47 is drawn out by the engaging pins 57 in a direction in which the ink ribbon 47 is extended, whereupon this ink ribbon 47 is inserted and placed between the printing head 17 and the platen 16**.

When the supporting frame 48 has its posture changed, the engaging pin 57 is moved in a direction in which the arm portion **18*b* extends. When the supporting frame 48 has been brought to the horizontal condition as a result of that movement, the ink ribbon 47 between the arm portions 18*b* of the ribbon cassette 18 is inserted and placed between the printing head 17 and the platen 16. When the supporting frame 48 has been resultantly brought to the condition obliquely upwardly directed toward the front-face side of the printer housing 1, the ink ribbon 47 becomes stretched between the fore ends of the arm portions 18*b*. More specifically, the engaging groove 56 is extended in the direction in which the arm portions 18*b* are extended. When the attitude of the supporting frame 48 is changed from the obliquely upwardly directed condition thereof to the horizontal condition, the movable pin 54 is moved, integrally with the engaging pin 57, in the extending direction of the arm portions 18*b*. At this time, the supporting frame 48 is made horizontal through the movement of the engaging pin 57, at which time, the ink ribbon 47 between the arm portions 18*b* of the ribbon cassette 18 is inserted and disposed between the printing head 17 and the platen 16. When, conversely, the attitude of the supporting frame 48 is changed from its horizontal condition to its obliquely upwardly directed condition, the movable pin 54 is moved integrally with the engaging pin 57 in a reverse direction from the above-mentioned direction. Through this movement, the ink ribbon 47 is taken up with the drive force of the ribbon feed motor 50. When the supporting frame 48 has been brought to the above-mentioned obliquely upwardly directed condition, the ink ribbon 47 is stretched between the fore ends of the arm portions 18*b***.

The movable pin 54 is driven, via the arm 85, by the motor 24 for adjusting the spacing between the printing head 17 and the platen 16. The arm 85 is rockably supported by supporting pins 58 respectively integrally mounted to the side plates 15 so as to permit the movement of the movable pin 54. On the arm 85 there is provided a driving gear 59, in corresponding relation to which there is disposed a sector gear 60 meshed with the driving gear 22 for adjusting the spacing between the printing head 17 and the platen 16.

The sector gear 60 transmits the drive force of the motor 24 to the driving gear 59 so as to drive the supporting frame 48 to one of the horizontal condition thereof and the condition thereof obliquely upwardly directed toward the front-face side of the printer housing 1. When the supporting frame 48 has been brought to the horizontal condition, this sector gear 60 ceases to transmit the drive force of the motor 24 to the driving gear 59 so as not to drive the supporting frame 48. Further, the sector gear 60 is designed to specify the transmission time duration in which the drive force of the motor 24 is transmitted to the driving gear 59, so as to make the distance between the printing head 17 and the platen 16 larger than a standard gap and thereby enable the ink ribbon 47 between the arm portions **18*b* of the ribbon cassette 18 to be inserted into, or be withdrawn from, between the printing head 17 and the platen 16 under a condition wherein said distance is large enough to insert or withdraw the ink ribbon 47**.

Figure 7:
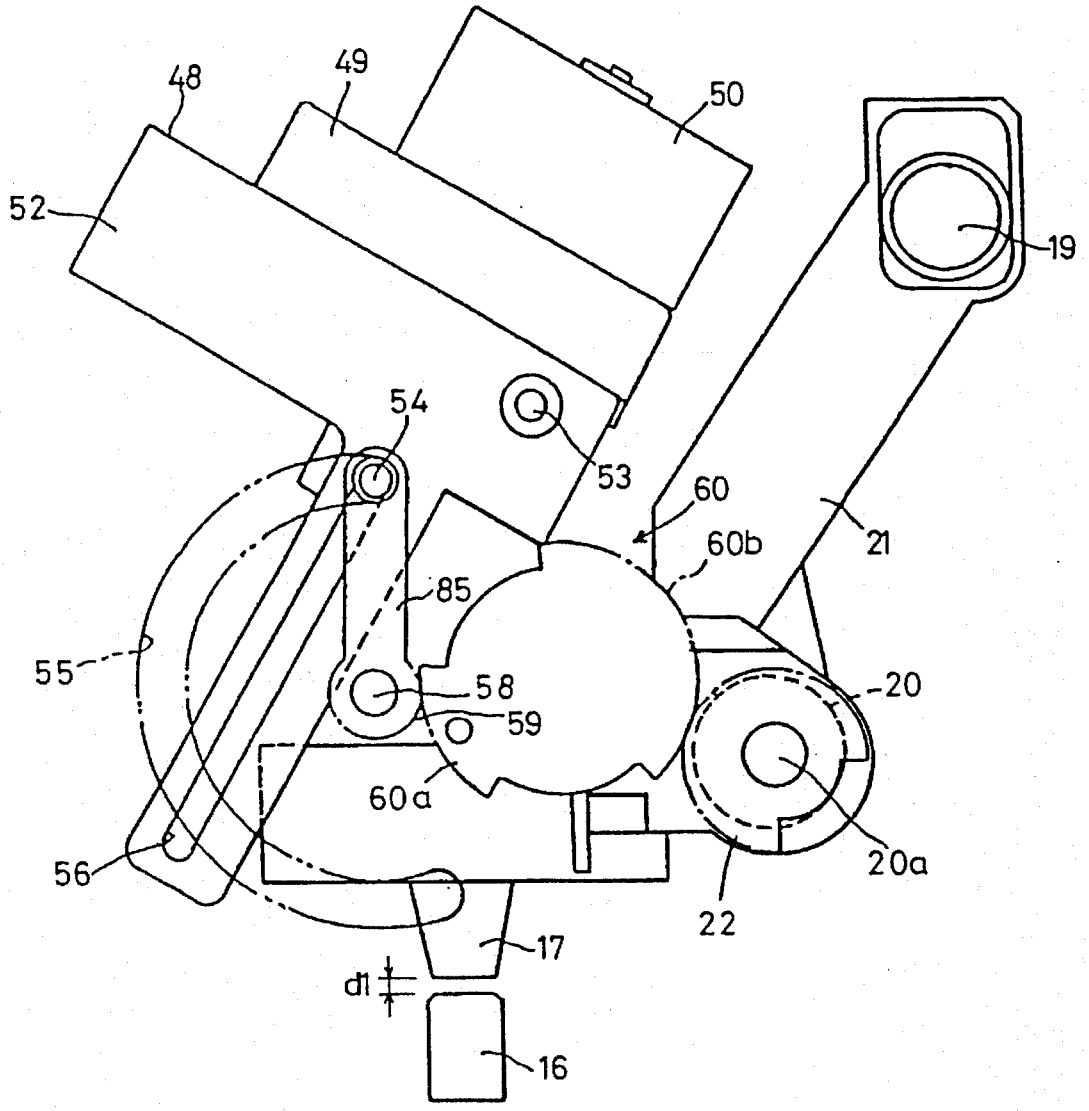
FIG. 7 is a side view of an essential portion, showing the operation of a sector gear in the mentioned one embodiment.
Figure 8:
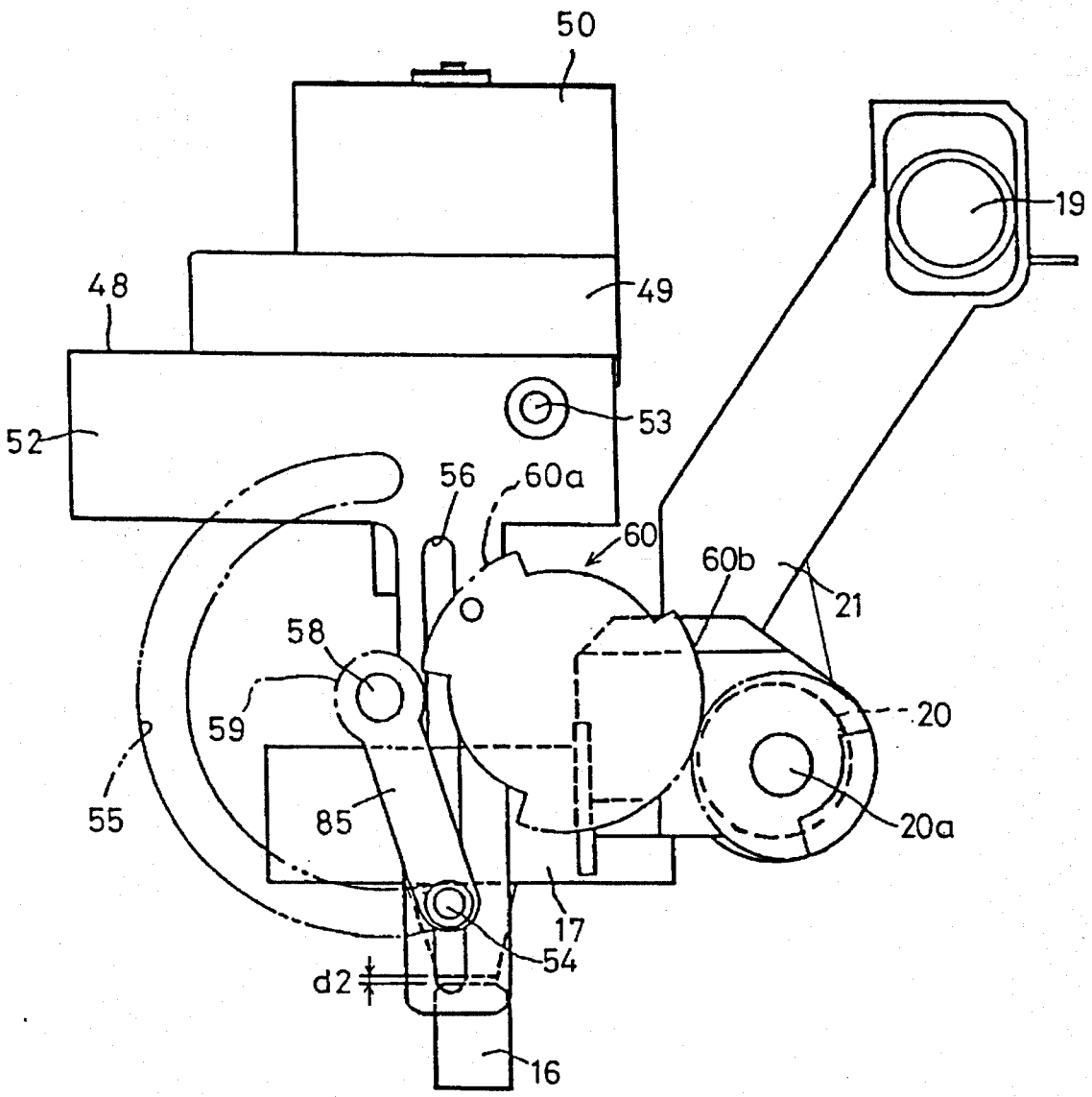
FIG. 8 is a side view of an essential portion, showing the operation of the sector gear in the mentioned one embodiment.
Figure 9:
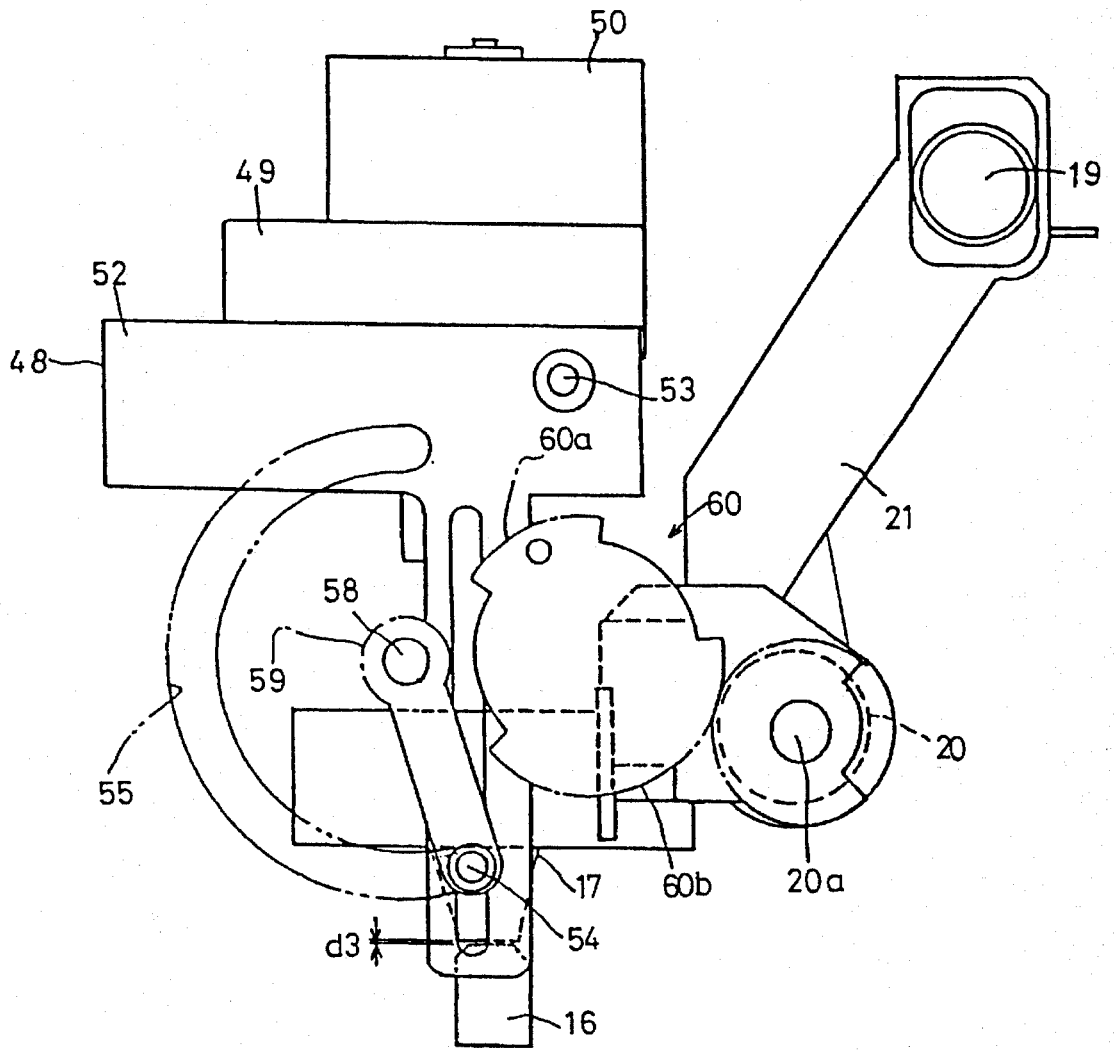
FIG. 9 is a side view of an essential portion, showing the operation of the sector gear in the mentioned one embodiment.

More specifically, the sector gear 60 is partially formed, on its outer periphery, with tooth portions **60*a* and 60*b* as shown in FIGS. 7 to 9, the driving gear 22 being meshed with one tooth portion 60*b*. When the supporting frame 48 is in its condition obliquely upwardly directed toward the front-face side of the printer housing 1, the tooth portion 60*a* is meshed with the driving gear 59 as shown in FIG. 7, in which condition, the spacing d1 between the printing head 17 and the platen 16 is maximized. Further, when the supporting frame 48 is brought to its horizontal condition, the tooth portion 60*a* becomes disengaged from the driving gear 59, as shown in FIG. 8, whereupon the transmission of the drive force to that gear 59 is rendered ineffective. In this condition, the spacing d2 between the printing head 17 and the platen 16 becomes smaller than the spacing d1. After the supporting frame 48 has been made horizontal, the motor 24 still continues to be driven. As a result, the spacing d3 between the printing head 17 and the platen 16 becomes smaller than the spacing d2 as shown in FIG. 9 and is set to become the standard gap. In this condition, the driving gear 59 corresponds to an intermediate zone between the tooth portions 60*a* and 60*b*. The spacing between the printing head 17 and the platen 16** is adjusted from that condition.

The operation of the dot impact printer according to this embodiment will now be described.

In a condition wherein the ribbon cassette 18 is loaded, the supporting frame 48 is set horizontally via the fixed pin 53 and the movable pin 54 as shown in FIG. 4. Under this condition, the ink ribbon 47 is drawn out, by the engaging pin 57, from the fore ends of the arm portions **18*b* in the extending direction thereof, and this ink ribbon 47 is inserted and placed between the printing head 17 and the platen 16**.

When it is desired to remove or unload the ribbon cassette 18, the opening/closing cover 51 of the printer housing 1 is opened, in which condition, the ribbon feed motor 50 and the motor 24 are driven. Thus, it is possible to easily remove the ribbon cassette 18.

More specifically, when the ribbon feed motor 50 is driven to rotate, the ink ribbon 47 is driven via the ribbon-driving wheel train. When, on the other hand, the motor 24 is driven, the eccentric shaft portion 20*a* of the guide shaft 20 is driven to rotate, whereupon the spacing between the printing head 17 and the platen 16 is enlarged to a sufficient extent for withdrawing the ink ribbon 47. Simultaneously, the movable pin 54 is driven, whereupon the supporting frame 48 is rocked about the fixed pin 53 and thus has its attitude altered. During the attitude alteration, the ribbon cassette 18 has its attitude altered, so that the ink ribbon 47 is withdrawn from between the printing head 17 and the platen 16. When the supporting frame 48 has thus been brought to the condition obliquely upwardly directed toward the front-face side of the printer housing 1 as shown in FIG. 5, the ribbon feed motor 50 and the motor 24 are stopped from being driven. If, in this condition, the ribbon cassette 18 is removed from the supporting frame 48, it will become unnecessary to take out the ribbon cassette 18 while drawing out the ink ribbon 47 from between the printing head 17 and the platen 16, but easy removing of the ribbon cassette 18 will become possible.

When it is desired to load the ribbon cassette 18 after the same has been removed, the ribbon cassette 18 is loaded into the supporting frame 48, in which condition, the ribbon feed motor 50 is driven and the motor 24 is reversely riven. By so doing, the ribbon cassette 18 can be easily loaded.

Namely, when the ribbon cassette 18 is loaded into the supporting frame 48, the engaging pins 57 are engaged with the ink ribbon 47 between the arm portions 18*b*. Thereafter, when the ribbon feed motor 50 is driven, the ink ribbon 47 is driven via the ribbon-driving wheel train. Further, when the motor 24 is reversely driven, the eccentric shaft portions 20*a* of the guide shaft 20 are reversely driven to rotate, whereupon the movable pin 54 is driven in the direction reverse from the direction in case of the above-mentioned removal of the ribbon cassette 18. By this driving, the supporting frame 48 has its attitude changed to the horizontal direction. Simultaneously, the ink ribbon 47 is drawn out from the fore ends of the arm portions 18*b*, by the engaging pins, in the extending direction thereof. By this draw-out of the ink ribbon 47 and the change in attitude of the supporting frame 48, the ink ribbon 47 between the arm portions 18*b* is inserted between the printing head 17 and the platen 16. At this time of insertion, the spacing between the printing head 17 and the platen 16 is enlarged sufficiently for the insertion of the ink ribbon 47, whereupon the ink ribbon 47 is smoothly inserted between the printing head 17 and the platen 16. When the supporting frame 48 is made horizontal, the motor 24 is stopped from being driven. As a result, the ink ribbon 47 is inserted and placed between the printing head 17 and the platen 16 as shown in FIG. 4. Further, after the lapse of a time period necessary for the ink ribbon 47 to be steadily located between the printing head 17 and the platen 16, the ribbon feed motor 50 stops being driven, whereupon the loading of the ribbon cassette 18 is completed. Accordingly, it is not necessary to load the ribbon cassette 18 while inserting the ink ribbon 47 between the printing head 17 and the platen 16, but this ribbon cassette 18 can be easily loaded.

As described above, according to this embodiment, there is no need to remove the ribbon cassette 18 while withdrawing the ink ribbon 47 from between the printing head 17 and the platen 16, or to load the ribbon cassette 18 while inserting the ink ribbon 47 into between the printing head 17 and the platen 16, but it is possible to easily removably load the ribbon cassette 18, thus enhancing the loading/unloading operation efficiency for the ribbon cassette 18.

Further, this embodiment is constructed such that the engaging pin 57 is provided on the movable pin 54 and, by the engaging pins 57, the ink ribbon 47 is drawn out from the fore ends of the arm portions 18*b* in the extending direction thereof, thus to be inserted and placed between the printing head 17 and the platen 16. Therefore, the arm portion 18*b* of the ribbon cassette 18 can be set to have a short length. This provides an advantage in making the ribbon cassette 18 compact in size.

Figure 10:
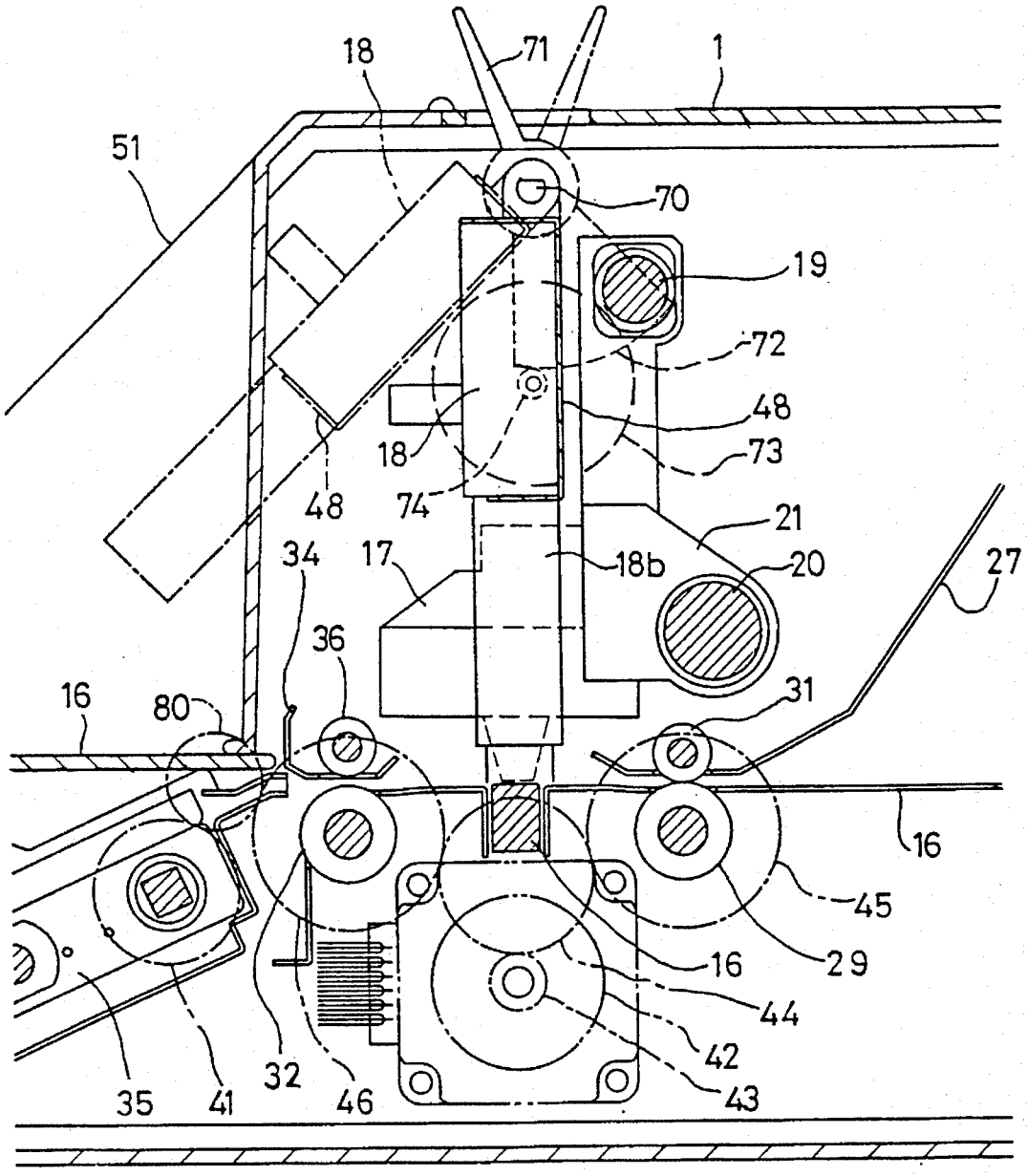
FIG. 10 is a longitudinal sectional view showing a second embodiment of the first invention.
Figure 11:
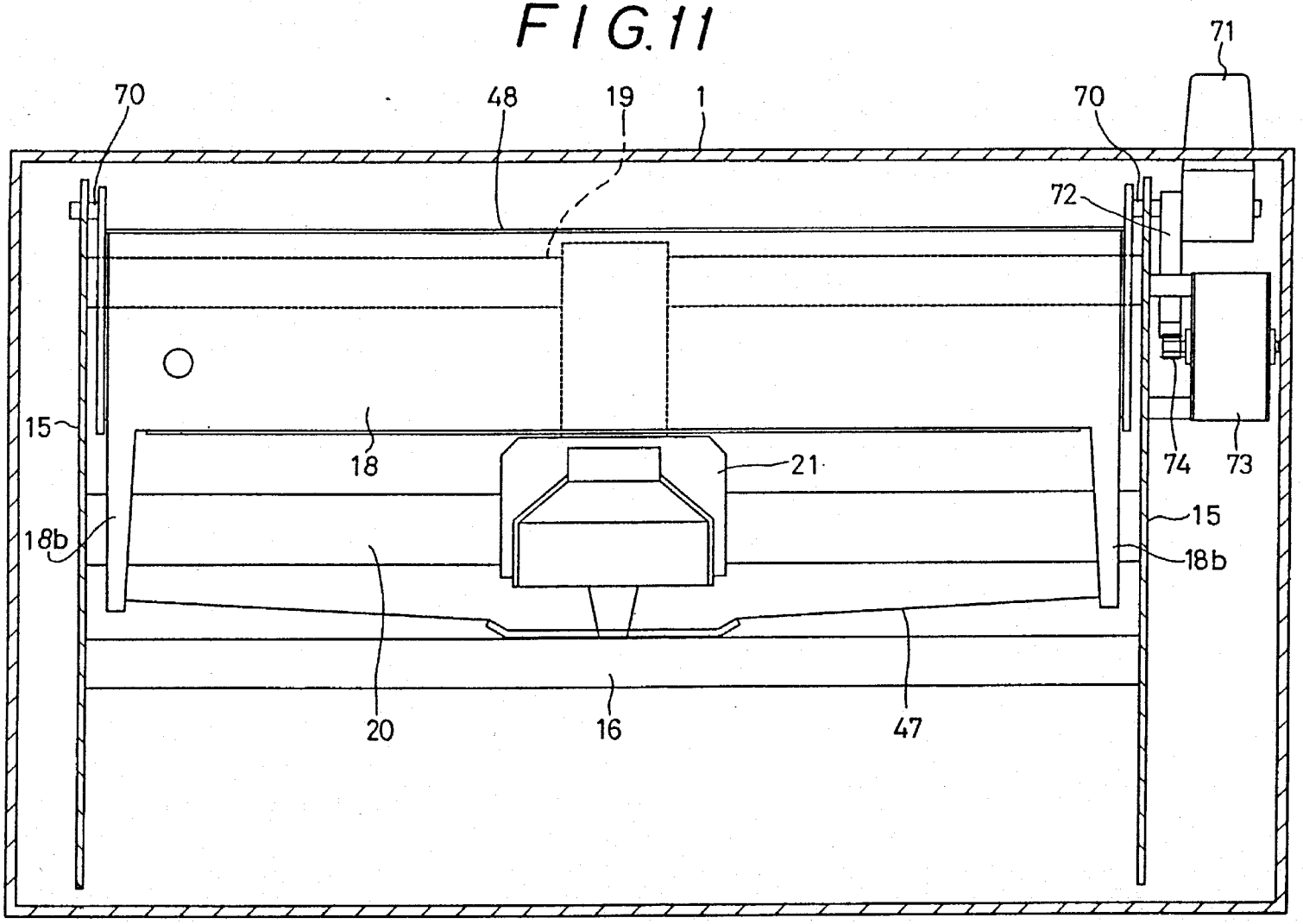
FIG. 11 is a sectional view of an essential portion of FIG. 10.

The dot impact printer according to a second embodiment of the present invention will now be described with reference to FIGS. 10 and 11.

In this second embodiment, the arm portions 18*b* of the ribbon cassette 18 are extended in a direction going along with the flat surface of the cassette. The ribbon cassette 18 is vertically installed, and the ink ribbon 47 is inserted and placed between the printing head 17 and the platen 16 by being guided by the arm portions 18*b*. The supporting frame 48 is integrally provided with a pair of supporting pins 70, via which the supporting frame 48 is rockably supported by the side plates 15. An operation lever 71 is mounted on the supporting pin 70 co-rotatably therewith, i.e., so as to be rocked together with the supporting pin 70. As a result, the supporting frame 48 can be rocked about the supporting pin 70 by operating the operation lever 71. A sector gear 72 is co-rotatably mounted on the supporting pin 70. A pinion gear 74 mounted on a driving shaft of a motor 73 is meshed with the sector gear 72.

By operating the operation lever 71, or by driving of the motor 73, the supporting frame 48 is rocked whereupon the ink ribbon 47 is inserted into, or withdrawn from, between the printing head 17 and the platen 16. Note that ribbon faced means not shown for driving the ink ribbon 47 is loaded on the supporting frame 48.

In this second embodiment as well, therefore, it is not necessary to remove the ribbon cassette 18 while drawing out the ink ribbon 47 from between the printing head 17 and the platen 16, or to load the ribbon cassette 18 while inserting the ink ribbon 47 into between the printing head 17 and the platen 16. Resultantly, easy loading/unloading of the ribbon cassette 18 is possible as in the preceding embodiment.

Although, in the above-mentioned embodiments, the supporting frame 48 is supported in a rockable manner, the invention permits the supporting frame 48 to be supported in a slidable manner and thereby permits the ink ribbon 47 to be inserted into, or withdrawn from, between the printing head 17 and the platen 16 through the sliding operation of the supporting frame 48.

The dot impact printer to which the second invention is applied will now be described with reference to the drawings.

Figure 12:
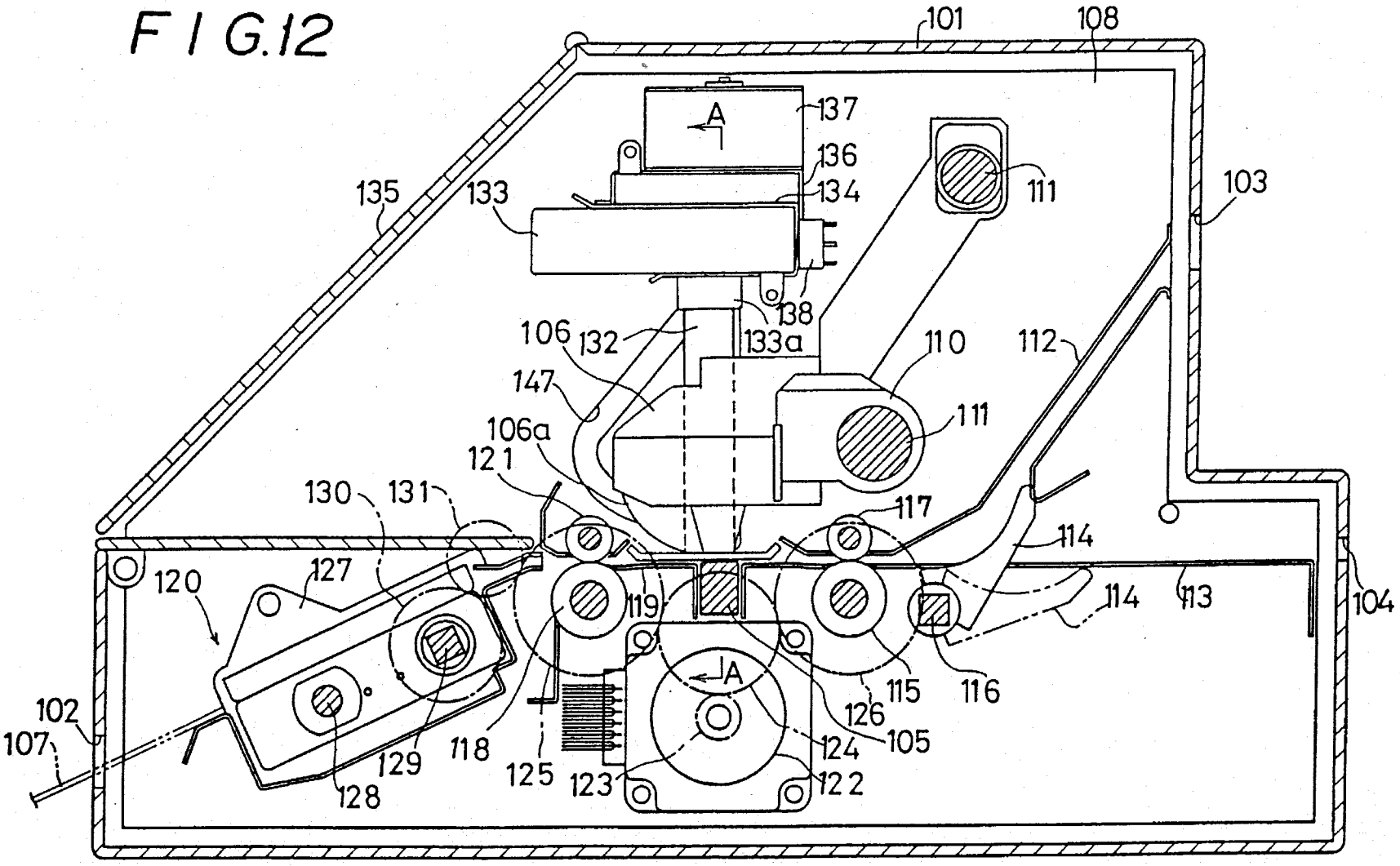
FIG. 12 is a longitudinal sectional view of a dot impact printer to which the second invention is applied.

In this printer, as shown in FIG. 12, the printer housing 101 is formed, at its front face, with the paper supply slot 102 and is formed, at its rear face portion, with the paper discharge slots 103 and 104. Within the printer housing 101, there are provided the platen 105 and the printing head 106 disposed opposing the platen 105 at an upper position than the position of this platen 105. With this arrangement, the continuous paper 107 is inserted from the paper supply slot 102 and is fed between the platen 105 and the printing head 106, and is printed. After this paper 107 has been printed, the continuous paper 107 thus printed is selectively discharged from any one of the paper discharge slots 103 and 104.

Figure 13:
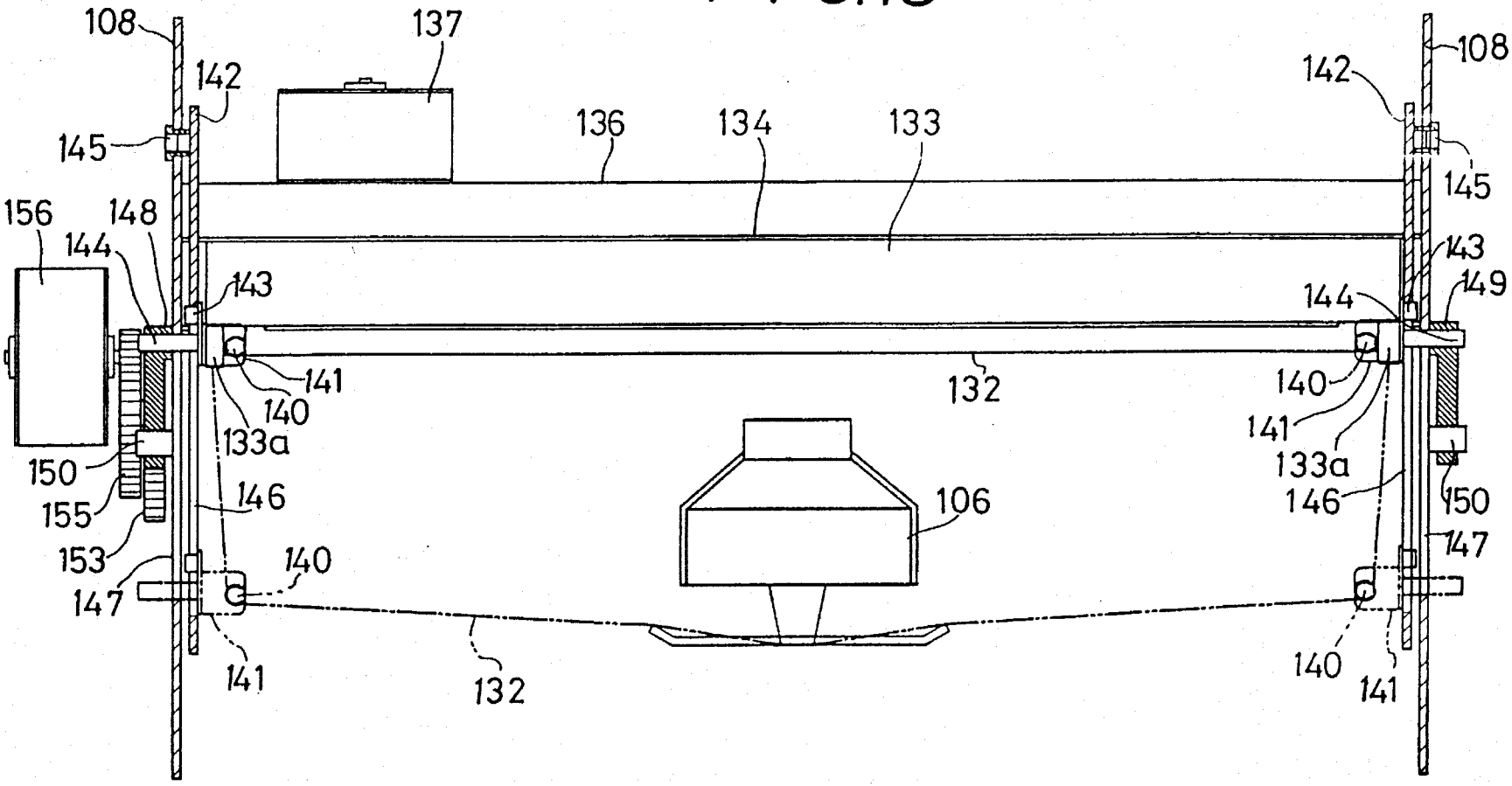
FIG. 13 is a sectional view of an essential portion, showing a set condition of a ribbon cassette in the mentioned second invention, the view being taken along the line A—A of FIG. 12.

Within the printer housing 1, as shown in FIG. 13 as well, the side plates 108 are erected, in parallel relation to each other, at both sides thereof, respectively. The platen 105 and the printing head 106 are disposed between the side plates 108. The platen 105 is provided extending in the direction perpendicular to the paper feed direction, and the platen 105 is fixedly supported, at its both end portions, by the side plates 108. The printing head 106 is loaded on the head carrier 110, and is slidably supported by a pair of guide shafts 111 via the head carrier 110. The guide shafts 111 are extended in parallel with the platen 105 and are fixedly supported, at their both end portions, by the side plates 108. The head carrier 110 is slidably engaged with the head carrier 110 at its intermediate portion. Accordingly, the printing head 106 is made movable, in parallel with the platen 105, in the direction perpendicular to the paper feed direction along the pair of guide shafts 111.

At the downstream side of the printing head 106, there are provided the paper guide 112 for guiding the printed continuous paper 107 to the paper discharge slot 103, the paper guide 113 for guiding the printed continuous paper 107 to the paper discharge slot 104, the paper switching lever 114 for changing over the paper discharge path of the continuous paper 107 so as to cause the printed continuous paper 107 to be selectively discharged from either one of the paper discharge slots 103 and 104, and the paper discharge roller 115. The paper guides 112 and 113 are so provided as to branch the paper discharge passageway for the continuous paper 107 into the two paper discharge paths at the downstream side of the paper discharge roller 115. The paper switching lever 114 is mounted, at its one end, to the driving shaft 116 at a position near a branched portion of the paper discharge passageway for the continuous paper 107. The lever 114 thus changes over the paper discharge path for the continuous paper 107 by being rocked, as indicated in FIG. 12 by a two-dot and dash line, through the rotation of the driving shaft 116. The driving shaft 116 is driven to rotate with the drive force of a motor not shown. The driven, or pinch, roller 117 is located opposing the paper discharge roller 115 which pinches and feeds the continuous paper 107 in co-operation with that pinch roller 117. To the pinch roller 117 there is transmitted the rotating force of the paper discharge roller 115 by means of a gear not shown. At the upstream side of the printing head 106, there are provided the paper feed roller 118 for feeding the continuous paper 107 into between the platen 105 and the printing head 106, the paper guide 119 for guiding the continuous paper 107 into between the printing head 106 and the platen 105, and the tractor 120 located at a side upstream from the paper feed roller 118. The driven, or pinch, roller 121 is located opposing the paper feed roller 118 which pinches and feeds the continuous paper 107 in co-operation with that pinch roller 121. To the pinch roller 121 there is transmitted the rotating force of the paper feed roller 118 by means of a gear not shown.

The paper feed roller 118 is driven to rotate, by the paper feed motor 122, together with the paper discharge roller 115. That is, the pinion gear 123 is mounted on the driving shaft of the paper feed motor 122. With this pinion gear 123 there is meshed the intermediate gear 124, with which the driving gears 125, 126 are meshed. These driving gears 125, 126 are mounted on the paper feed roller 118 and the paper discharge roller 115, respectively. Thus, the paper head roller 118 and the paper discharge roller 115 are driven to rotate, by the paper feed motor 122, via the pinion gear 123, intermediate gear 124, and driving gears 125, 126.

The tractor 120 is provided one pair in number (in the drawing, only one-side tractor is illustrated), and these tractors are loaded in the tractor frame 127. This tractor frame 127 is extended in the direction perpendicular to the paper feeding direction, and is supported, at its both end portions, by the side plates 108. To the tractor frame 127 are mounted the guide shaft 128 and the drive shaft 129 both of which extend in the direction perpendicular to the paper feed direction. Each tractor 120 is slidably engaged with the guide shaft 128 and the driving shaft 129 and can be positionally adjusted in corresponding relation to the width dimension of the continuous paper 107.

The tractor 120 is provided with a sprocket not shown which is rotated integrally with the driving shaft 129. Each end portion of the continuous paper 107 is engaged with that sprocket via the paper supply slot so as to set the continuous paper 107 and then feed the continuous paper 107 into between the paper feed roller 118 and the pinch roller 121 through the rotation of the driving shaft 129. This driving shaft 129 is mounted, at its one end, with the driving shaft 130 via which the driving shaft 129 is driven to rotate, by the paper feed motor 122, together with the paper feed roller 118 and the paper discharge roller 115. Namely, the driving gear 130 is meshed with the driving gear 125 via the intermediate gear 131, whereupon the driving shaft 129 is driven to rotate, by the paper feed motor 122, jointly with the paper feed roller 118 and the paper discharge roller 115.

A ribbon cassette 133 containing an ink ribbon 132 is disposed above the printing head 106, and the ink ribbon 132 of this ribbon cassette 133 is inserted and placed between the printing head 106 and the platen 105.

The ribbon cassette 133 is retained, by the supporting frame 13, between the side plates 108 at an upper position than the position of the printing head 106. The supporting frame 134 is formed to have a horizontally-thrown U-shaped cross-section, and has its both ends fixedly supported by the side plates respectively, and has an intermediate portion in which the ribbon cassette 133 is received and retained. The ribbon cassette reception portion of the supporting frame 134 is made open toward the front-face side of the printer housing 101 so as to enable the ribbon cassette 133 to be loaded or unloaded from the front-face side of the printer housing 101 by releasing the opening/closing cover 135 mounted on the front face of the printer housing 101. To the supporting frame 134 there are mounted a gear box 136 having mounted thereon the ribbon feed motor 137 containing the ribbon-driving wheel train not shown and intended to drive it, and a microswitch 138. As a result, via the ribbon-driving wheel train, the ink ribbon 132 can be driven to travel by the ribbon feed motor 137 while, on the other hand, the loading or unloading of the ribbon cassette 133 can be detected by the microswitch 138 as one example of the detecting means.

Figure 14:
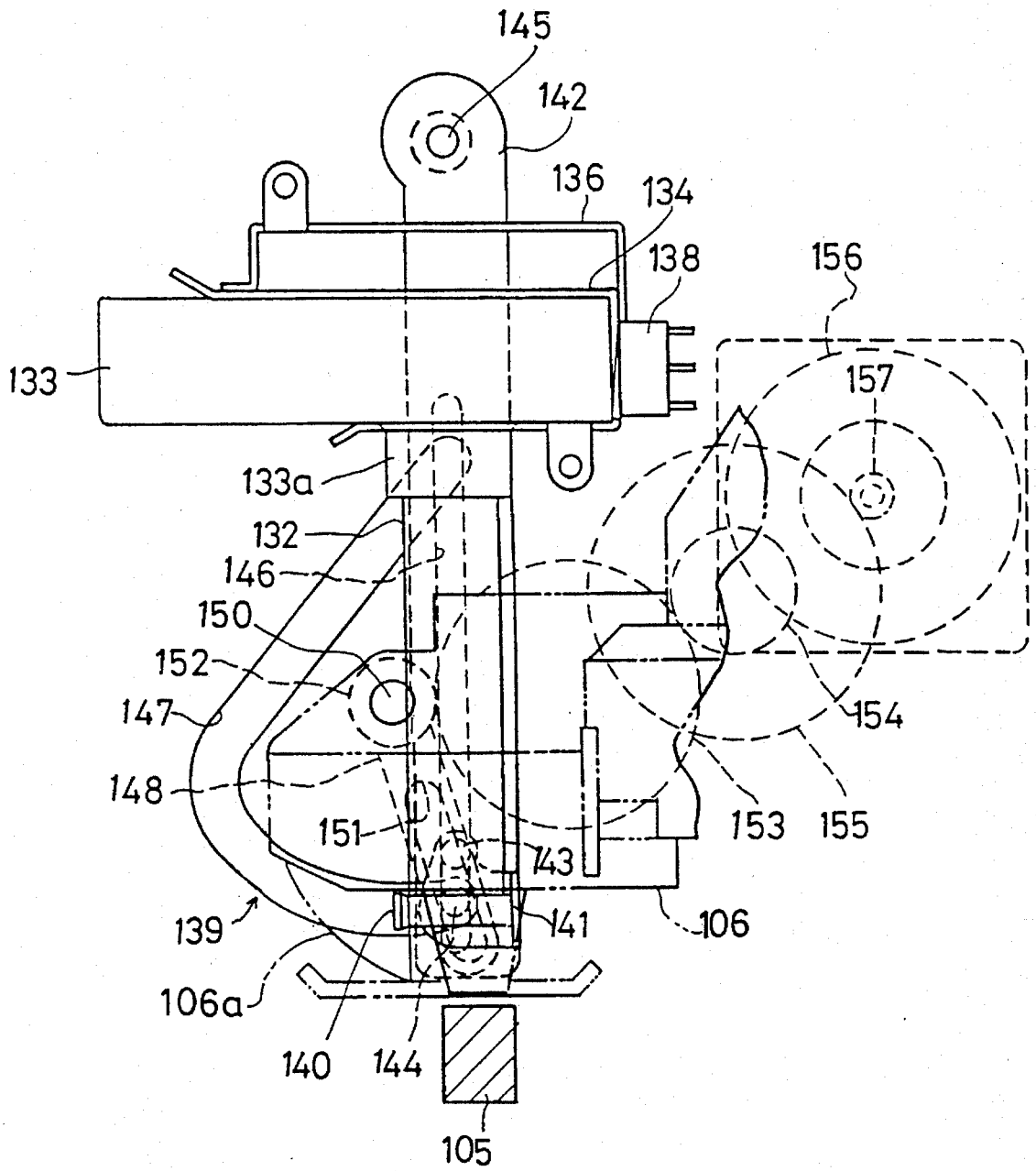
FIG. 14 is a longitudinal sectional view of an essential portion, showing an auto loading means in the mentioned second invention.

The ribbon cassette 133 is formed, at its both ends, with the arm portions **133*a* which downwardly protrude in a direction orthogonal to the flat face of the cassette as shown in FIG. 13 as well. The ink ribbon 132 is exposed between the fore end portions of those arm portions 133*a* and is inserted and placed between the printing head 106 and the platen 105. The fore end portions of the arm portions 133*a* are located above the printing head 106. The ink ribbon 132 between the fore end portions of the arm portions 133*a* is downwardly drawn out from the fore end portions thereof by operation of the auto loading means 139 whose details are shown in FIG. 14. Thus, the ink ribbon 132 is inserted and placed, or loaded, between the printing head 106 and the platen 105**.

The auto loading means 139, as shown in FIGS. 13 and 14, is provided with the pair of movable pins 140 respectively engaged with both end portions of the ink ribbon 132 located between the fore end portions of the arm portions 133*a*. The ink ribbon 132 located therebetween is inserted and placed between the printing head 106 and the platen 105 by those movable pins 140.

As shown in FIGS. 13 and 14, each movable pin 140 is mounted on its corresponding supporting plate 141 via which the movable pin 140 is engaged with its corresponding arm 142 and then with its corresponding side plate 108. The supporting plate 141 is formed by being shaped, in section, like a letter L. The movable pin 140 is mounted on one-side flat surface of that bifurcated supporting plate 141, on the other-side flat surface of which there are mounted engaging pins 143, 144, via which the supporting plate 141 is engaged with its corresponding arm 142 and its corresponding side plate 108. The arm 142 is rockably supported inside the side plate 108 via a supporting pin 145, and this arm 142 is formed with an engaging groove 146 which is elongate and extends in the longitudinal direction of the arm 142. The engaging pin 143 is slidably engaged with that engaging groove 146. The side plate 108 is formed with an L-shaped engaging groove 147 inclined slantwise. With this engaging groove 147 there is slidably engaged the engaging pin 144 via the engaging groove 146.

Figure 15:
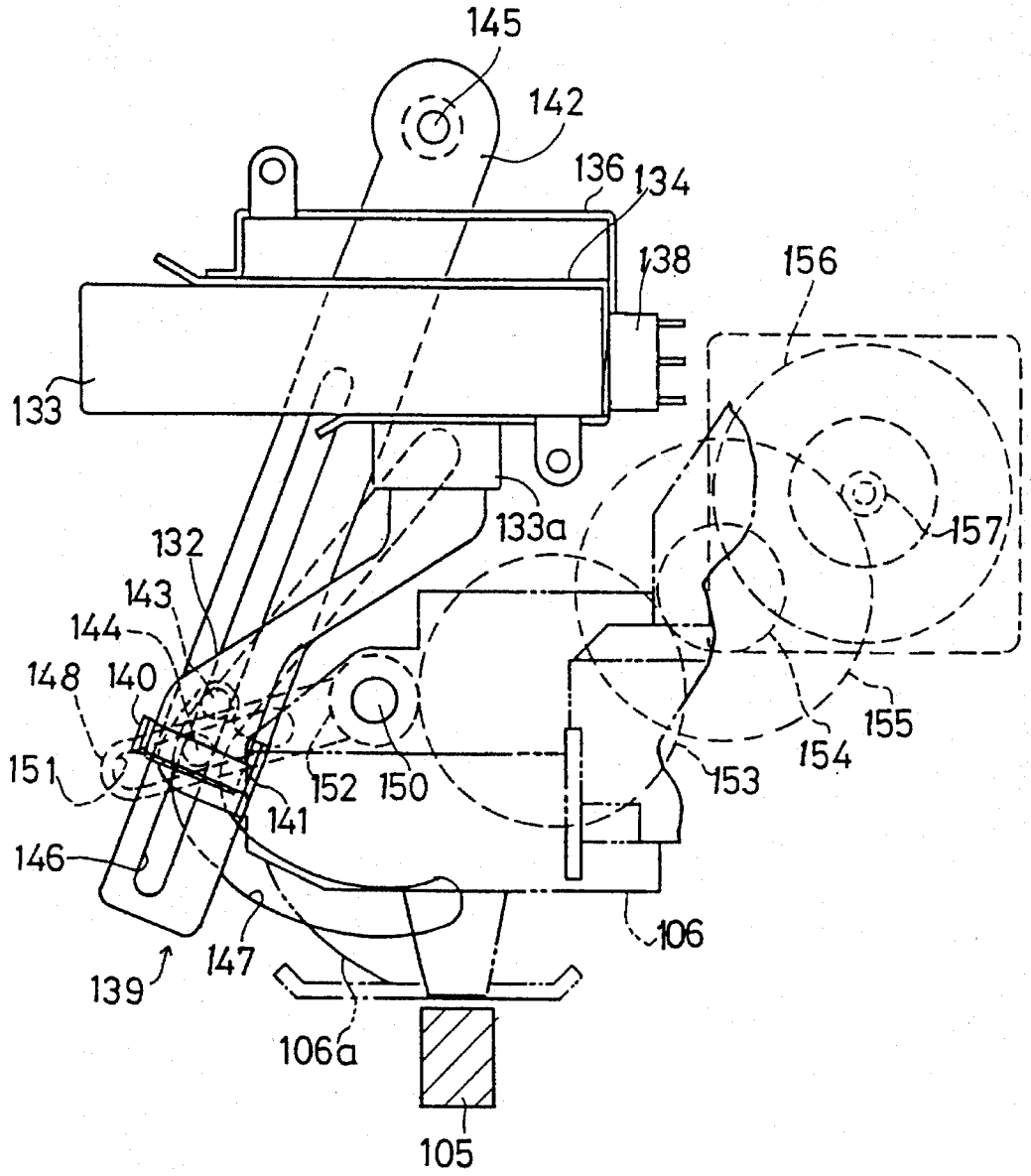
FIG. 15 is a longitudinal sectional view of an essential portion, showing the operation of the auto loading means in the mentioned second invention.
Figure 16:
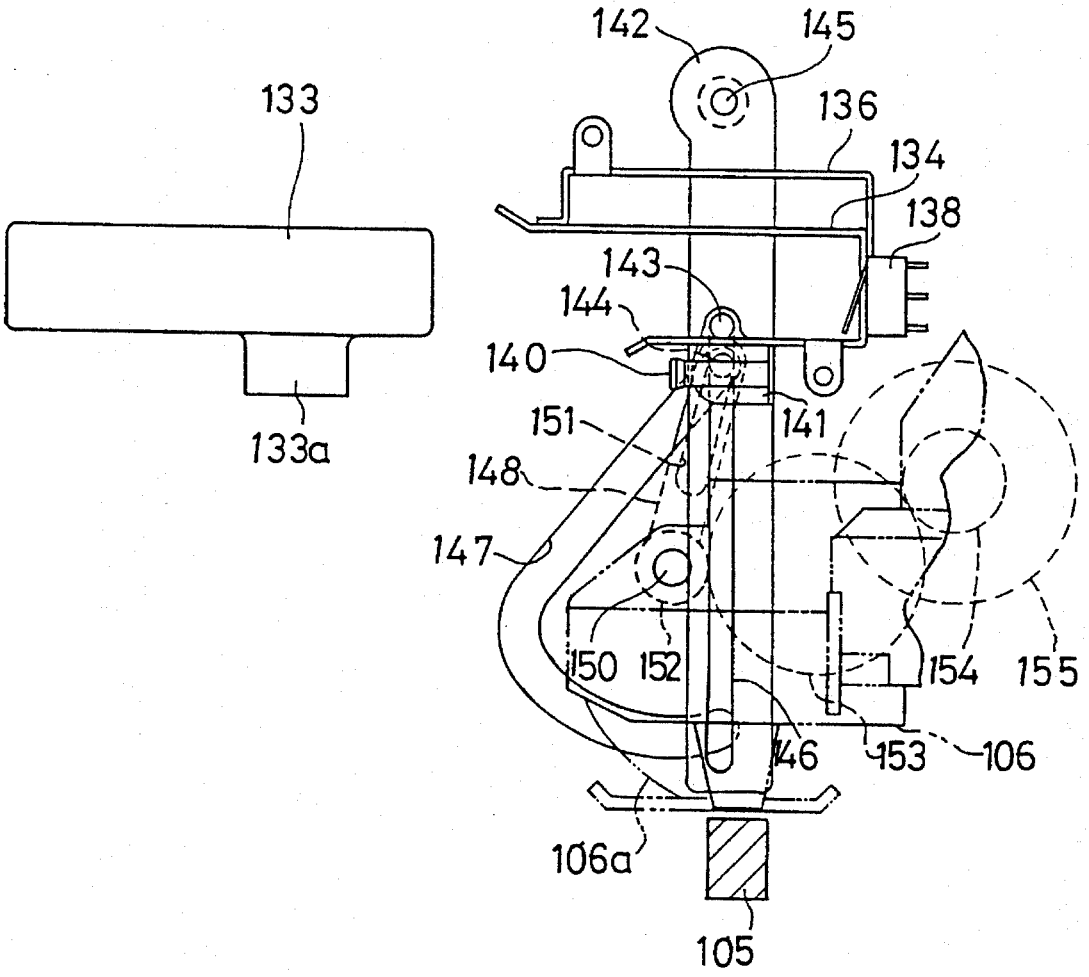
FIG. 16 is a longitudinal sectional view of an essential portion, showing the operation of the auto loading means in the mentioned second invention.

The engaging grooves 146, 147, as shown in FIG. 14, guide the movable pin 140 to the position which is below the arm portion 133*a* and slightly higher than the level corresponding to that between the printing head 106 and the platen 105, or, as shown in FIG. 16, guide the movable pin 140 to the position which is above the printing head and at a level adjacent to the arm portion 133*a*. When the movable pin 140 has been brought to that first-mentioned position, the ink ribbon 132 between the fore end portions of the arm portions 133*a* is inserted between the printing head 106 and the platen 105 (see the two-dot and dash line indicated position in FIG. 13). Conversely, when the movable pin 140 has been moved to that second-mentioned position, the ink ribbon 132 between the fore end portions of the arm portions 133*a* is drawn off from between the printing head 106 and the platen 105 (see the solid-line indicated position in FIG. 13). In an intermediate zone between the first and second-mentioned positions, where the ink ribbon 132 between the fore end portions of the arm portions 133*a* is going to either one of those positions, the guiding path for the movable pin 140 is so set, by the engaging grooves 146, 147, as to cause the ink ribbon 132 between the fore end portions of the arm portions 133*a* to bypass the printing head 106 without any interference with the same, as shown in FIG. 15. Note the followings. The printing head 106 is provided with a ribbon guide 106*a* for guiding the insertion of the ink ribbon 132 into between the printing head 106 and the platen 105. Even when the movable pin 140 is at the position which is slightly higher than that between the printing head 106 and the platen 105, the insertion of the ink ribbon between the fore end portions of the arm portions 133*a* into between the printing head 106 and the platen 105 is enabled by that ribbon guide 106*a*.

Each engaging pin 144 projects outwardly from its corresponding side plate 108 by passing through its corresponding engaging grooves 146 and 147, and this engaging pin 144 is engaged, outside the side plate 108, with its corresponding driving arm 148 or 149 as shown in FIG. 13. The driving arms 148 and 149 are rockably supported, outside the side plates, by the side plates 108, respectively, via supporting pins 150, and these driving arms 148, 149 are connected to each other by connecting means not shown so as to be integrally or jointly rocked. Each driving arm 148, 149 is formed with an elongate engaging groove 151 which extends in the longitudinal direction thereof. The engaging pin 144 is slidably engaged with that engaging groove 151. The respective lengths of the driving arm 148, 149 and the engaging groove (5) are so set as to move the movable pin 140, by the rocking movement of the driving arms 148, 149, to one of the two mentioned positions: the position (the FIG. 14 shown position) which is below the arm portions 133*a* and slightly higher than the level between the printing head 106 and the platen 105, and the position (the FIG. 16 shown position) which is upper than the position of the printing head 106 and at the level adjacent to the arm portion 133*a*. One driving arm 148 is integrally formed with the driving gear 152 coaxially with its portion 150 supported by the corresponding side plate 108. Via this driving gear 152, the driving arms 148, 149 are jointly and integrally driven to be rocked. More specifically, the driving gear 152 is meshed with a pinion gear 157 of a driving motor 156 via intermediate gears 153, 154 and 155. With the drive force of the driving motor 156, the driving arm 148 is driven to be rocked and the driving arm 149 receives the rocking force of the driving arm 148 via the connecting means, so that this driving arm 149 is jointly rocked integrally with the driving arm 148.

The driving motor 156 is automatically normally driven to rotate in response to a detection signal from the microswitch 138 when the ribbon cassette 133 is accommodated and retained in the supporting frame 134. Further, the driving motor 156 is reversely driven to rotate through the operation of an operation switch not shown. When the driving motor 156 is automatically normally driven to rotate in response to the detection signal from the microswitch 138, the driving arms 148, 149 are driven to be rocked in the direction in which the movable pin 140 is moved to the position (the FIG. 14 shown position) which is below the arm portions 133*a* and slightly higher than the level between the printing head 106 and the platen 105. On the other hand, when the driving motor 156 has been reversely driven to rotate through operation of the operation switch, the driving arms 148, 149 are driven to be rocked in the direction in which the movable pin 140 is moved to the position (the FIG. 16 shown position) which is above the printing head 106 and at a level adjacent to the arm portions 133*a*.

The microswitch 138 and the operation switch are designed to drive the ribbon feed motor 137 as well together with the driving motor 156. Namely, when the ribbon cassette 133 is accommodated into and retained by the supporting frame 134, the ribbon feed motor 137 is not only driven to rotate in response to the detection signal from the microswitch 138 but the driving motor 156 is normally driven to rotate. When the operation switch is operated, the ribbon feed motor 137 is not only driven to rotate but the driving motor 156 is reversely driven to rotate. Note that the ribbon feed motor 137 is also driven to rotate at the time of printing operation as well through the operation of a control circuit not shown.

The operation of the second invention will now be described.

FIG. 14 shows a condition wherein the ribbon cassette 133 is accommodated into and retained by the supporting frame 134 and the movable pin 140 is located at the position which is below the arm portions 133*a* and slightly higher than the level between the printing head 106 and the platen 105 whereupon the ink ribbon 132 between the fore end portions of the arm portions 133*a* is inserted and placed between the printing head 106 and the platen 105. In this condition, printing becomes possible.

When unloading the ribbon cassette 133 from the above-mentioned condition, the opening/closing cover 135 of the printer housing 101 is opened, in which condition, the ribbon feed motor 137 is driven to rotate and the driving motor 156 is reversely driven to rotate through the operation of the operation switch. This enables easy unloading of the ribbon cassette 133.

More specifically, when the ribbon feed motor 137 is driven to rotate, the ink ribbon 132 is driven via the ribbon-driving wheel train. Further, when the driving motor 156 is reversely driven to rotate, the driving arms 148, 149 are rocked whereupon the movable pin 140 is upwardly moved. As the movable pin 140 moves, the ink ribbon 132 is smoothly drawn off from between the printing head 106 and the platen 105 while being taken up. When the movable pin 140 has been brought to the position (the FIG. 16 shown position) which is upper than the position of the printing head 106 and at a level adjacent to the arm portions 133*a*, the ribbon feed motor 137 and the driving motor 156 are stopped from being driven, in which condition, if the ribbon cassette 133 is unloaded from the supporting frame 134 as shown in FIG. 16, unloading of the ribbon cassette 133 can be easily carried out. In such case, it is unnecessary to remove the ribbon cassette 133 while withdrawing the ink ribbon 132 from between the printing head 106 and the platen 105.

When loading the ribbon cassette 133 after removing the same, the opening/closing cover 135 of the printer housing 101 is opened. If, in this condition, the ribbon cassette 133 is set into the supporting frame 134, the ribbon feed motor 137 is driven in response to the detection signal from the microswitch 138 and the driving motor 156 is also driven to normally rotate. Thus, the ribbon cassette 133 can be easily loaded.

That is, when the ribbon cassette 133 has been accommodated into and retained by the supporting frame 134, the movable pins 140 are respectively engaged with both end portions of the ink ribbon 132 between the arm portions 133*a*, at the position upper than the printing head 106 and situated at a level adjacent to the arm portions 133*a*. When the ribbon feed motor 137 is then driven to rotate, the ink ribbon 132 is driven via the ribbon-driving wheel train. Further, when the driving motor 156 is driven for normal rotation, the movable pin 140 is downwardly moved, whereupon the ink ribbon 138 is downwardly moved while being drawn out from the fore end portions of the arm portions 133*a* and is smoothly inserted into between the printing head 106 and the platen 105. When the movable pin 140 has reached the position below the arm portions 133*a* and slightly higher than the level between the printing head 106 and the platen 105, the driving motor 156 stops being driven. As a result, as shown in FIG. 14, the ink ribbon 132 is inserted and placed between the printing head 106 and the platen 105. Thus, the ribbon feed motor 137 stops being driven after the lapse of a time period necessary for the ink ribbon 132 to be steadily placed between the printing head 106 and the platen 105. For this reason, the ribbon cassette 133 can be easily set without any need to set the ribbon cassette 133 while inserting the ink ribbon 132 into between the printing head 106 and the platen 105.

As has been described above, according to the above-mentioned embodiments, it is not necessary to unload the ribbon cassette 133 while withdrawing the ink ribbon 132 from between the printing head 106 and the platen 105, or to load the ribbon cassette 133 while inserting the ink ribbon 132 into between the printing head 106 and the platen 105, but it is possible to effect easy loading/unloading of the ribbon cassette 133. This enhances the loading/unloading operation efficiency for the ribbon cassette 133.

Further, according to the above-mentioned embodiments, the ink ribbon 132 between the fore end portions of the arm portions 133*a* is drawn out from those fore end portions by means of the movable pins 140, and this ink ribbon 132 is inserted and placed between the printing head 106 and the platen 105. With this arrangement, therefore, the arm portions 133*a* of the ribbon cassette 133 can each be set to have a short length, which provides an advantage for miniaturization of the ribbon cassette 133.

As has been explained above, the dot impact printer according to the present invention provides an excellent advantage that the ribbon cassette can be easily loaded or unloaded with no need to load the ribbon cassette while inserting the ink ribbon between the printing head and the platen, or to unload the ribbon cassette while drawing off from between the printing head and the platen, thereby enhancing the loading/unloading operation efficiency for the ribbon cassette.

What is claimed is:

1. A dot impact printer wherein a ribbon cassette formed, at both its end portions, with a pair of arm portions, respectively, between which an ink ribbon is exposed; and said ink ribbon between said arm portions is inserted and placed between a printing head and a platen, comprising: means for positioning a cassette in either a loading/unloading position or a ribbon insertion/draw-off position including:

(A) a supporting frame which supports said ribbon cassette in a removably attachable manner, said cassette being displaceable to first and second positions, said first position permitting said ink ribbon between said arm portions to be inserted and placed between the printing head and the platen, and said second position permitting said ink ribbon between said arm portions to be removed from between the printing head and the platen; and (B) driving means for driving said supporting frame to said first position for inserting said ink ribbon after a cassette loading operation and to said second position for drawing-off said ink ribbon before a cassette unloading operation.

2. The dot impact printer according to claim 1, wherein said driving means includes a sector gear for transmitting the drive force of a motor used to adjust the spacing between said printing head and said platen to said supporting frame so as to bring said supporting frame to said first and said second position, said sector gear ceasing to transmit said drive force to said supporting frame when said supporting frame has been brought to said first position.

3. The dot impact printer according to claim 2, wherein said motor is driven to make said spacing between said printing head and said platen larger than a standard gap when said motor drives said supporting frame, and is driven to make said spacing between said printing head and said platen equal to said standard gap when said supporting frame has been brought to said first position.

4. The dot impact printer according to claim 1, wherein said ink ribbon is driven when said supporting frame is driven.

5. The dot impact printer according to claim 1, wherein said supporting frame is provided with an auto loading means which, when said supporting frame is brought to said first position, draws out said ink ribbon between said arm portions in a direction in which said arm portions extend and guides said ink ribbon into between said printing head and said platen.

6. The dot impact printer according to claim 5, wherein said auto loading means includes a moving member engageable with said ink ribbon between said arm portions and movable in the extending direction of said arm portions.

7. A dot impact printer wherein a ribbon cassette formed, at both its end portions, with a pair of arm portions, respectively, between which an ink ribbon is exposed; and the ink ribbon between the arm portions is inserted and placed between a printing head and a platen, comprising:

a supporting frame for fixedly retaining the ribbon cassette in a removably attachable manner, and an auto loading means which, in a condition wherein the ribbon cassette is retained by said supporting frame, moves the ink ribbon between the arm portions between an insertion position permitting ink ribbon to be inserted between the printing head and the platen and to a removed position permitting the ink ribbon between the arm portions to be removed from between the printing head and the platen.

8. The dot impact printer according to claim 7, wherein said auto loading means includes a pair of moving members engageable with both end portions between the arm portions in a condition in which the ribbon cassette is retained by said supporting frame, said auto loading means driving said pair of moving members to move said ink ribbon between said arm portions to said insertion position or said draw-out position.

* * * * *